US010744810B2

(12) United States Patent
Sunaoshi et al.

(10) Patent No.: US 10,744,810 B2
(45) Date of Patent: Aug. 18, 2020

(54) BINDING MECHANISM AND BINDING UNIT

(71) Applicants: KABUSHIKI KAISHA TOSHIBA, Tokyo (JP); TOSHIBA TEC KABUSHIKI KAISHA, Tokyo (JP)

(72) Inventors: Takamitsu Sunaoshi, Yokohama Kanagawa (JP); Takahiro Kokubo, Kamakura Kanagawa (JP); Shunsuke Hattori, Kawasaki Kanagawa (JP); Kikuo Mizutani, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 16/106,888

(22) Filed: Aug. 21, 2018

(65) Prior Publication Data

US 2019/0143732 A1 May 16, 2019

(30) Foreign Application Priority Data

Nov. 14, 2017 (JP) ..... 2017-219380

(51) Int. Cl.
*B42C 9/00* (2006.01)
*B42D 3/00* (2006.01)

(52) U.S. Cl.
CPC ..... *B42C 9/0068* (2013.01); *B42D 3/002* (2013.01)

(58) Field of Classification Search
CPC ..... B32B 37/0046; B65H 35/0033; B65H 37/005; B42C 9/0062; B42C 9/0068; B42D 3/002
See application file for complete search history.

(56) References Cited

U.S. PATENT DOCUMENTS

| | | | | |
|---|---|---|---|---|
| 4,534,817 | A * | 8/1985 | O'Sullivan | B29C 65/08 100/26 |
| 5,980,676 | A | 11/1999 | Meetze | |
| 2016/0031200 | A1 | 2/2016 | Taki et al. | |
| 2018/0148294 | A1 | 5/2018 | Sunaoshi et al. | |
| 2018/0150016 | A1* | 5/2018 | Sunaoshi | B65H 37/04 |

FOREIGN PATENT DOCUMENTS

| | | | |
|---|---|---|---|
| JP | H09024682 | A | 1/1997 |
| JP | 2007153463 | A | 6/2007 |
| JP | 2013233724 | A | 11/2013 |
| JP | 2014177056 | A | 9/2014 |
| JP | 2016030400 | A | 3/2016 |
| JP | 2016055616 | A | 4/2016 |
| JP | 2016148018 | A | 8/2016 |
| JP | 2018083714 | A | 5/2018 |
| JP | 2018083715 | A | 5/2018 |

* cited by examiner

*Primary Examiner* — Mark A Osele
*Assistant Examiner* — Christopher C Caillouet
(74) *Attorney, Agent, or Firm* — Kim & Stewart LLP

(57) ABSTRACT

A binding mechanism has a base, a feeder, a tape cutting unit, a tape holding unit and a tape support driving unit. The feeder is supported by the base. The feeder feeds an adhesive tape. The tape cutting unit is supported by the base. The tape cutting unit cuts the fed adhesive tape. The tape holding unit can hold the fed adhesive tape. The tape support units are installed as a pair. The tape support driving unit drives the pair of tape support units such that the pair of tape support units hold the fed adhesive tape simultaneously.

15 Claims, 17 Drawing Sheets

BINDING MECHANISM AND BINDING UNIT

CROSS-REFERENCE TO RELATED APPLICATION

This application claims priority from Japanese Patent Application No. 2017-219380 filed on Nov. 14, 2017, the contents of which are incorporated herein by reference in their entirety.

FIELD

Embodiments described herein relate generally to a binding mechanism and a binding unit.

BACKGROUND

As a binding mechanism, a binding mechanism configured to bind an edge portion of a paper bundle using a stapler with a metal needle is mainstream.

Meanwhile, as a binding mechanism that does not damage the paper, a binding mechanism configured to bind an edge portion of a paper bundle using an adhesive tape is known. For example, the binding mechanism may be built into an image forming apparatus or applied as a handy type. The binding mechanism is used with an arbitrary posture in many cases.

However, the adhesive tape may not be firmly held due to the posture of a binding mechanism main body.

BRIEF DESCRIPTION OF THE DRAWINGS

FIG. 6(*a*) is a plan view of the tape cutting unit according to the embodiment. FIG. 6(*b*) and FIG. 6(*c*) are views for explaining an operation of the tape cutting unit according to the embodiment.

FIG. 10(*a*) is a side view of the vertical driving mechanism according to the embodiment. FIG. 10(*b*) and FIG. 10(*c*) are views for explaining an operation of the vertical driving mechanism according to the embodiment.

FIG. 13(*a*) is a side view of the horizontal driving mechanism according to the embodiment. FIG. 13(*b*) is a view for explaining an operation of the horizontal driving mechanism according to the embodiment.

DETAILED DESCRIPTION

Figure 1:
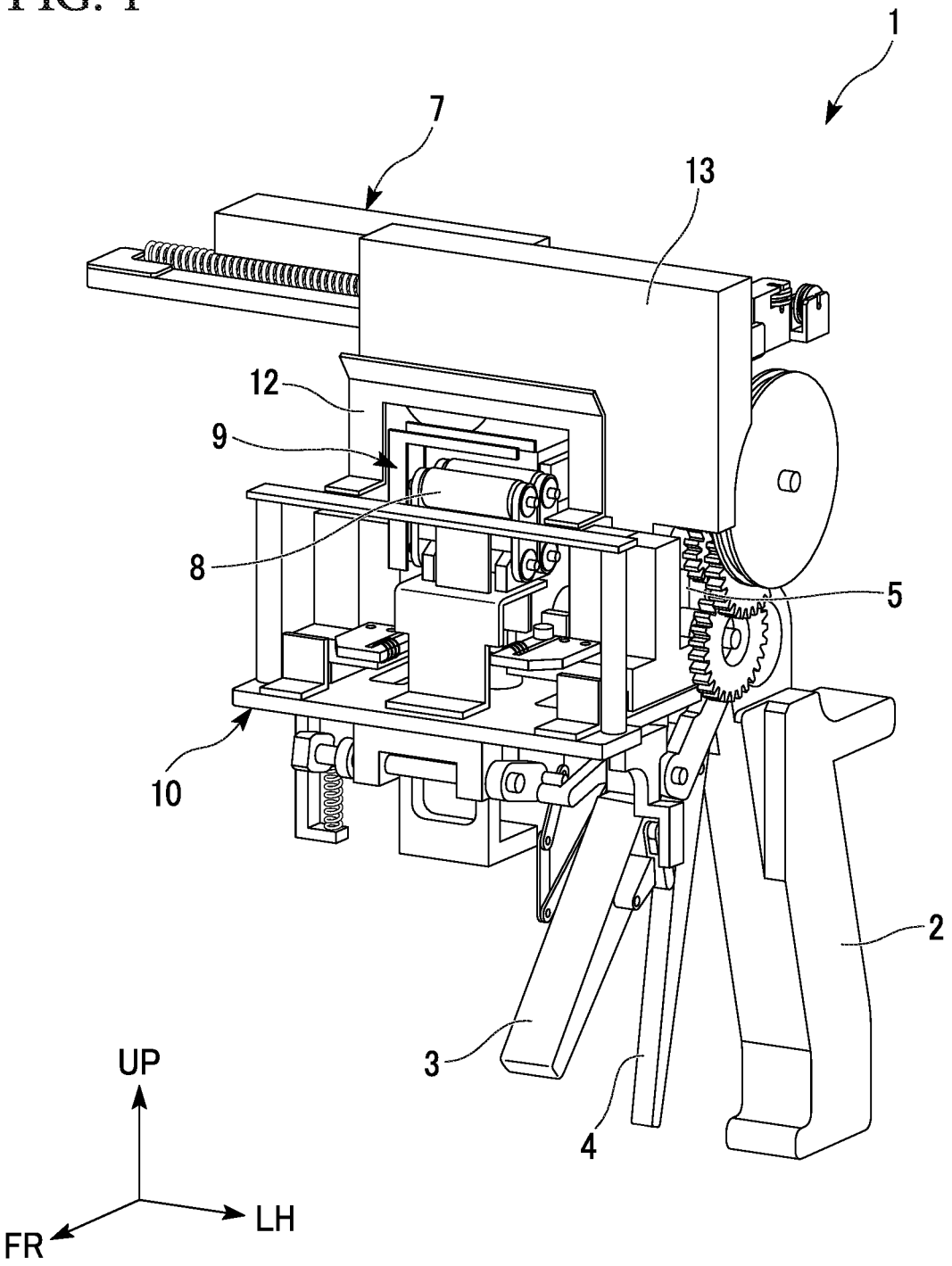
FIG. 1 is a perspective view showing a binding mechanism according to an embodiment.

A binding mechanism of an embodiment has a base, a feeder, a tape cutting unit, a tape holding unit and a tape support driving unit. The feeder is supported by the base. The feeder feeds an adhesive tape. The tape cutting unit is supported by the base. The tape cutting unit cuts the fed adhesive tape. The tape holding unit can hold the fed adhesive tape. The tape support units are installed as a pair. The tape support driving unit drives the pair of tape support units such that the pair of tape support units hold the fed adhesive tape simultaneously.

Hereinafter, a binding mechanism of an embodiment will be described with reference to the accompanying drawings. In the drawings, components which are the same are designated by the same reference numerals.

A binding mechanism 1 will be described.

Figure 2:
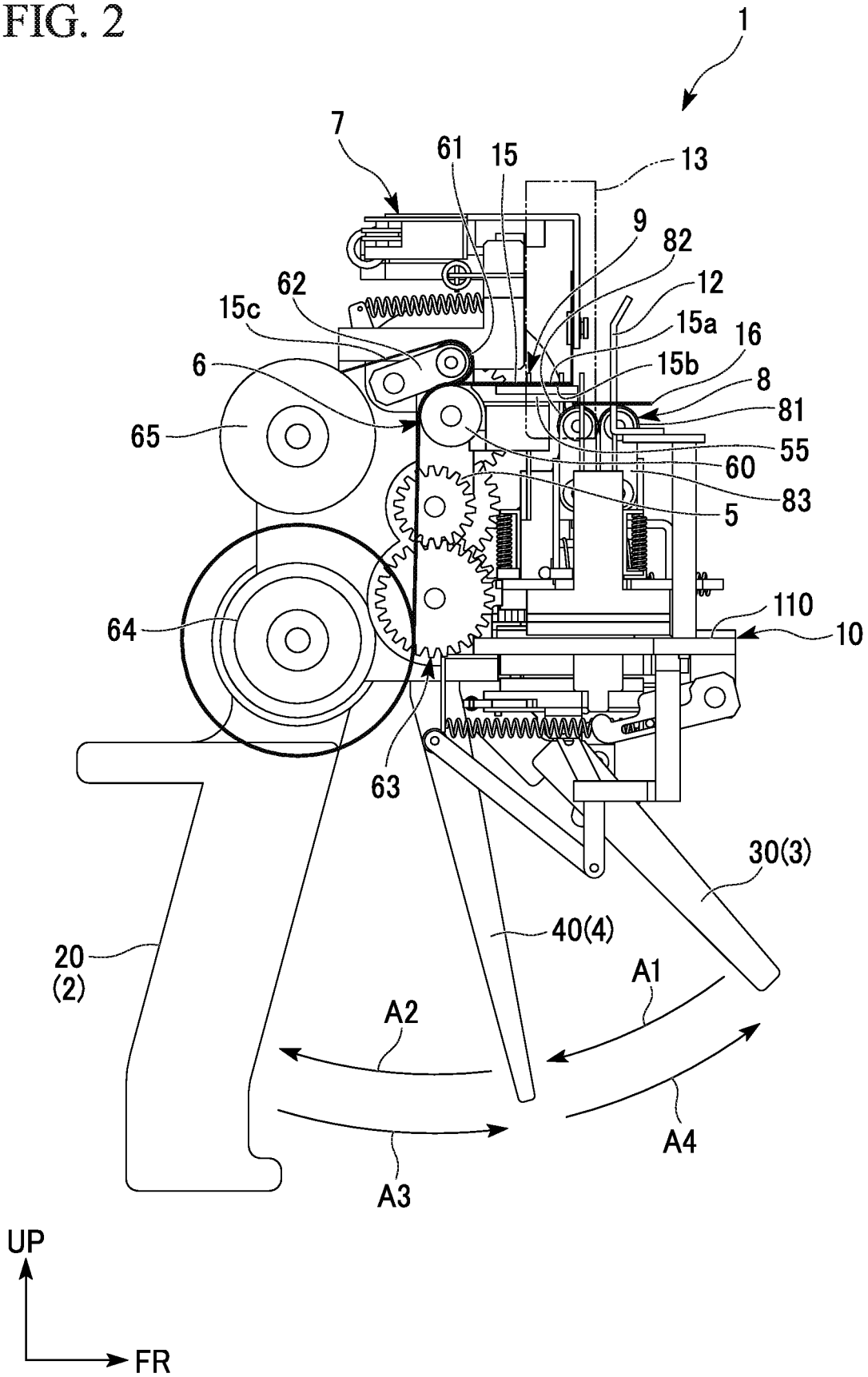
FIG. 2 is a side view of the binding mechanism according to the embodiment.

FIG. 1 is a perspective view showing the binding mechanism 1 according to the embodiment. FIG. 2 is a side view of the binding mechanism 1 according to the embodiment. In FIG. 1, a handy type binding mechanism 1 is shown.

As shown in FIG. 1, the binding mechanism 1 includes a grip 2, levers 3 and 4, a base 5, a feeder 6 (see FIG. 2), a tape cutting unit 7, a paper guide 12, a cover guide 13, a tape adhesion unit 8, tape support units 9 and a tape support driving unit 10.

For example, the binding mechanism 1 may be installed hanging on an image forming apparatus (not shown). The binding mechanism 1 is not interlocked with the image forming apparatus. The binding mechanism 1 is independently used. A paper bundle (member to be bound) (not shown) can be bound by an adhesive tape 15 (a tape piece 16, see FIG. 2) at an arbitrary timing using the binding mechanism 1.

The grip 2 will be described.

The grip 2 is gripped during use of the binding mechanism 1. For example, the grip 2 may be gripped by one hand of a user. For example, a paper bundle may be gripped by the other hand of the user. Since the grip 2 is gripped by one hand, the binding mechanism 1 can be used with an arbitrary posture.

FIG. 1 shows a posture when the binding mechanism 1 is standing vertically. In the following description, in a vertical direction (a first direction), toward a side of the grip 2 will be described as downward, and toward a side opposite to the grip 2 will be described as upward. In a direction perpendicular to the vertical direction, a direction toward a side of a lever 3 (the first lever 3) is referred to as forward, and a direction toward a side opposite to the lever 3 is referred to as backward. A direction perpendicular to the vertical direction and a horizontal direction (a second direction) is referred to as a lateral direction (a third direction). In the lateral direction, a direction toward a side of the tape holding unit 9 is referred to as a rightward direction, and a direction toward a side opposite to the tape holding unit 9 is referred to as a leftward direction.

Figure 3:
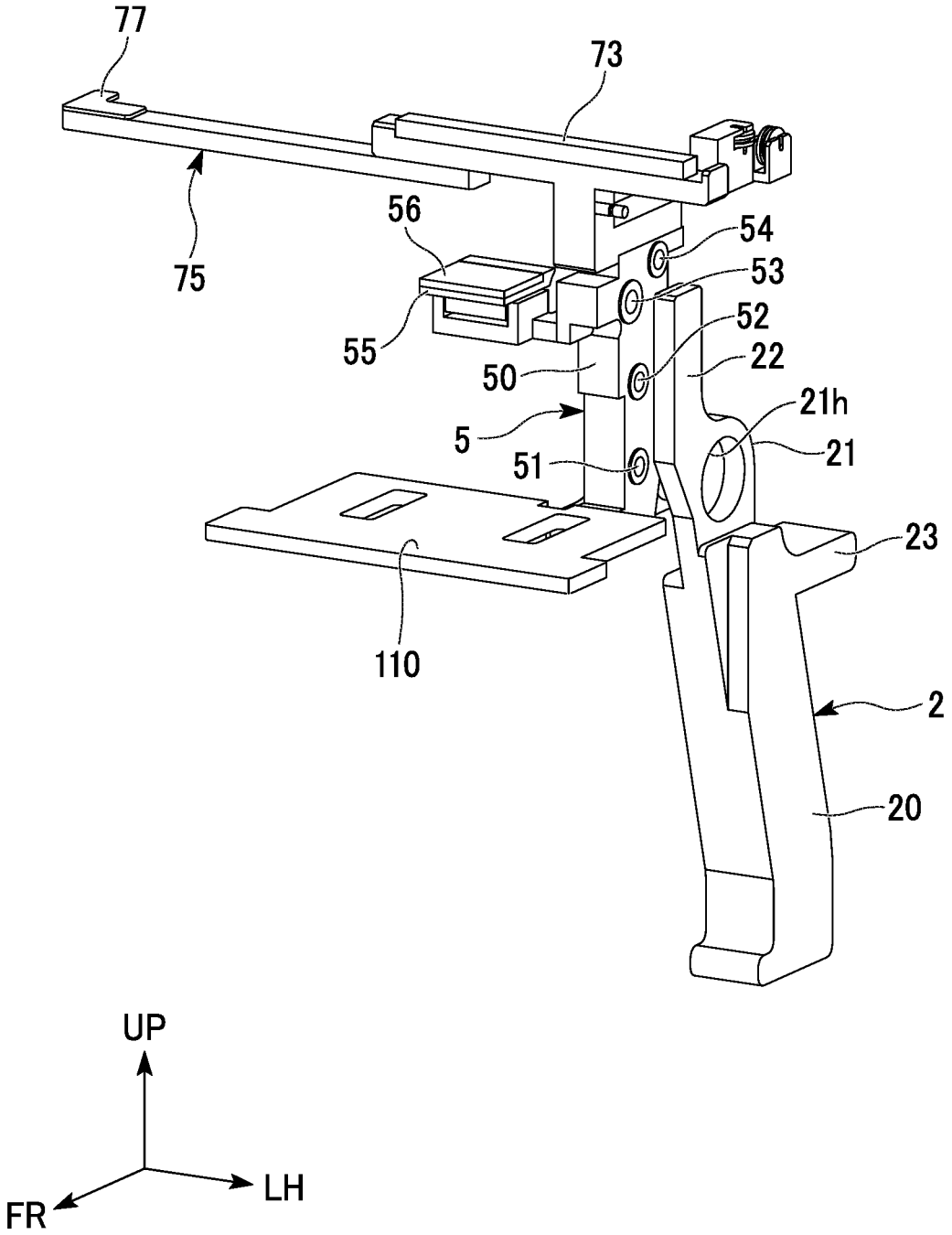
FIG. 3 is a perspective view of a base according to the embodiment.

FIG. 3 is a perspective view of the base 5 according to the embodiment. In FIG. 3, in addition to the base 5, the grip 2 or the like is shown.

As shown in FIG. 3, the grip 2 includes a grip main body 20, a reel support section 21, a base connecting section 22 and a mechanism weight support section 23. For example, the grip main body 20, the reel support section 21, the base connecting section 22 and the mechanism weight support section 23 are integrally formed of the same member.

The grip main body 20 has a shape that can be gripped by a user. The grip main body 20 is formed in a columnar shape that is slightly inclined to be disposed further forward toward the upper side.

The reel support section 21 supports a tape reel 64 (see FIG. 2). The reel support section 21 protrudes upward from an upper end of the grip main body 20. A circular through-hole 21*h* (hereinafter, also referred to as "a circular hole 21*h*") that opens in the lateral direction is formed in the reel support section 21.

The base connecting section 22 is connected to the base 5. The base connecting section 22 protrudes upward from a front upper portion of the reel support section 21.

The mechanism weight support section 23 can support the weight of the binding mechanism 1 close at hand when a user grips the grip main body 20. The mechanism weight support section 23 protrudes rearward from an upper end portion of the grip main body 20.

The levers 3 and 4 will be described.

Figure 4:
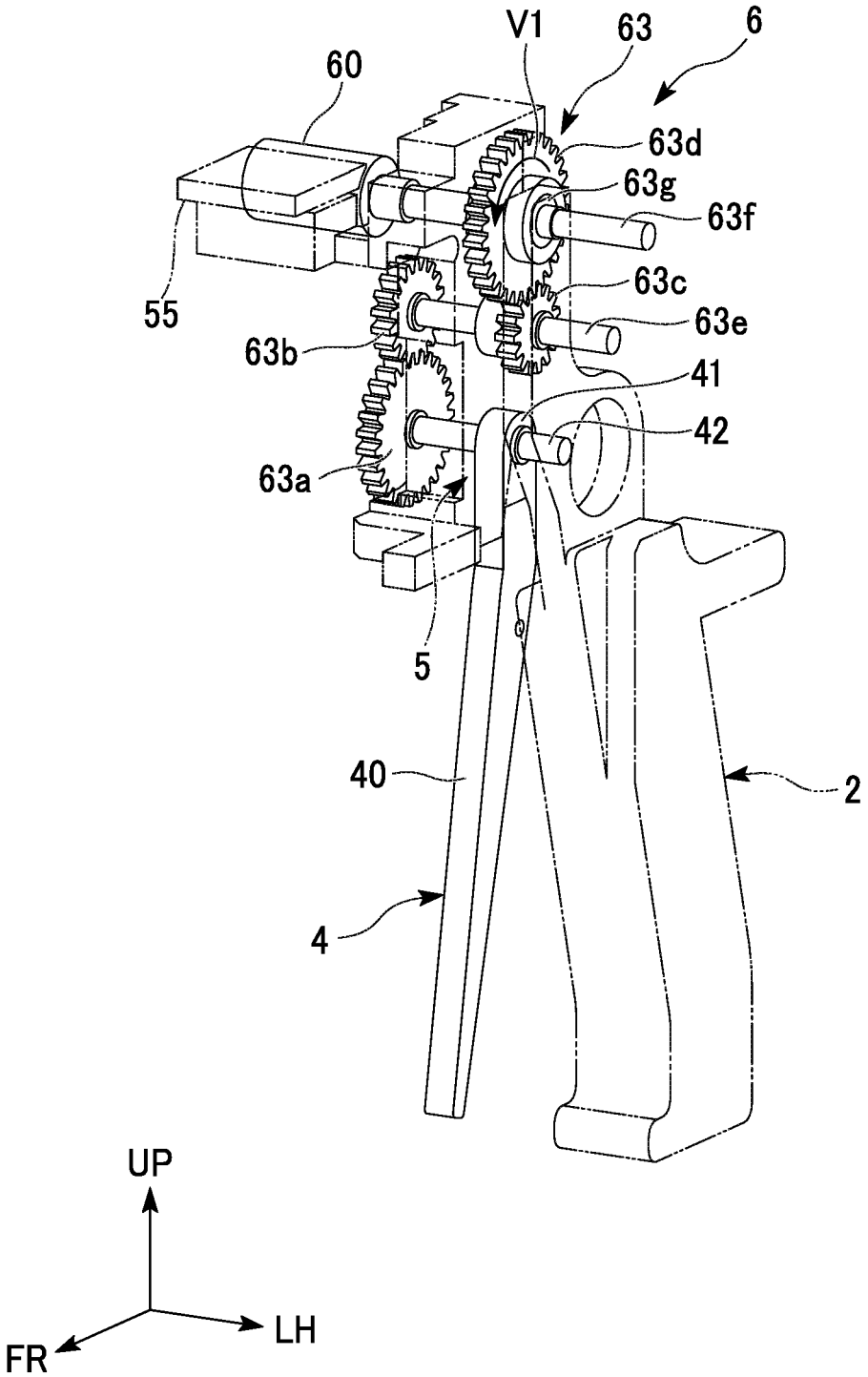
FIG. 4 is a perspective view of a feeder according to the embodiment.
Figure 5:
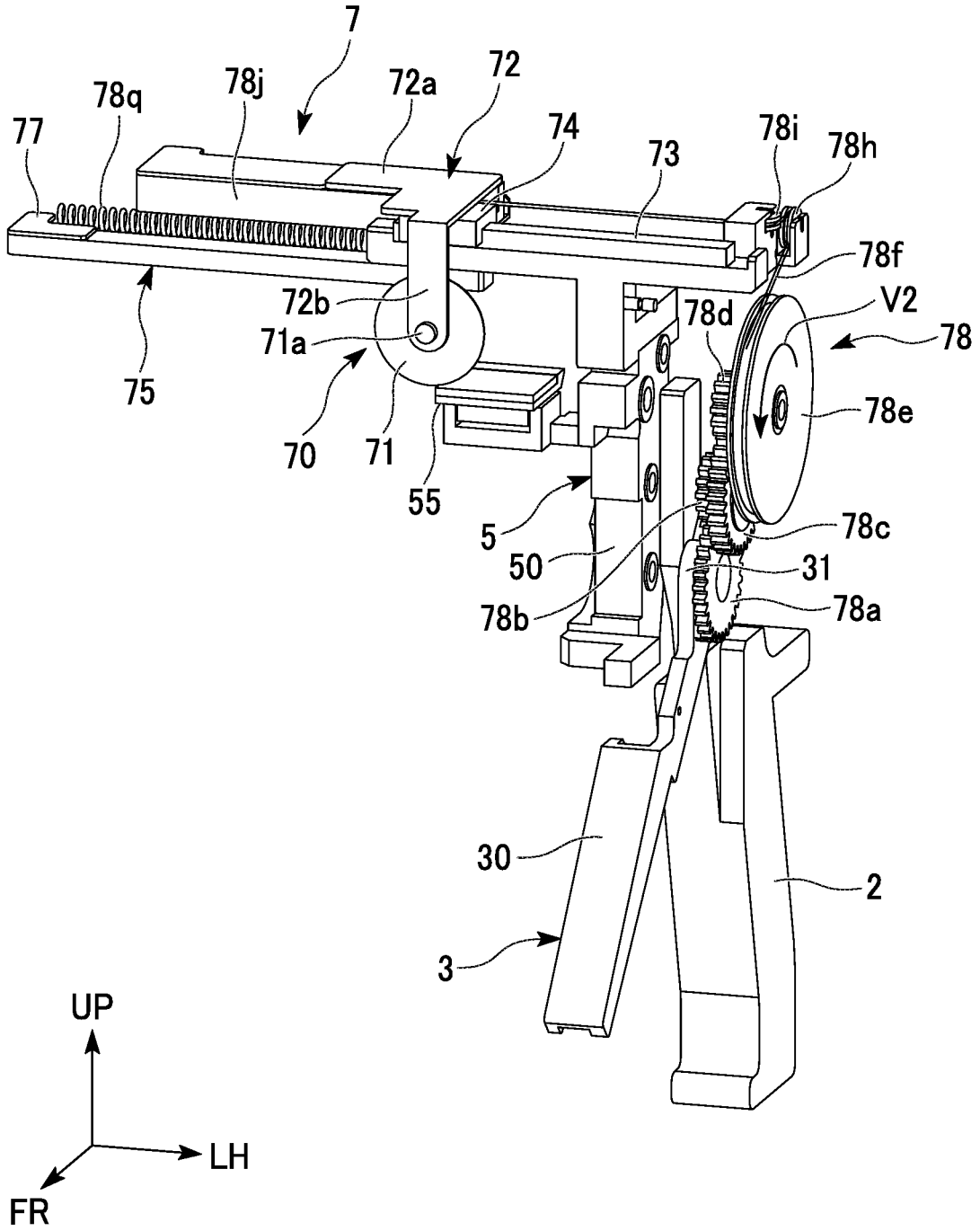
FIG. 5 is a perspective view of a tape cutting unit according to the embodiment.

FIG. 4 is a perspective view of the feeder 6 according to the embodiment. FIG. 5 is a perspective view of the tape cutting unit 7 according to the embodiment. In FIG. 4, in addition to the feeder 6, the second lever 4 or the like is shown. In FIG. 5, in addition to the tape cutting unit 7, the first lever 3 or the like is shown.

The levers 3 and 4 are operating sections that are operated by a user's finger or the like when the binding mechanism 1 is used. The levers 3 and 4 are biased in a direction away from the grip 2. The levers 3 and 4 are movable in a direction of approach to the grip 2. The levers 3 and 4 are installed on front and rear sides as a pair. The pair of levers 3 and 4 are the first lever 3 and the second lever 4.

As shown in FIG. 5, the first lever 3 is disposed in front of the grip 2. The first lever 3 is inclined and extends substantially in vertical direction so that the lowerend of the first lever 3 is located at the front side and the upperend of the first lever 3 is located at the rear side. The first lever 3 includes a first lever main body 30 and a first lever connecting section 31. The first lever 3 functions as a first operation input unit that can input an operation to a vertical driving mechanism 120 (a first driving mechanism, see FIG. 9).

A user's finger or the like comes into contact with the first lever main body 30 when the first lever 3 is operated. The first lever main body 30 is formed in a rectangular shape having a short side in the lateral direction.

The first lever connecting section 31 pivotably supports the first lever 3. The first lever connecting section 31 is disposed on an upper end portion of the first lever 3. A through-hole 31*h* (hereinafter, also referred to as "a first lever shaft hole 31*h*," see FIG. 9) that opens in the lateral direction is formed in the first lever connecting section 31. For example, a bearing (not shown) is installed in the first lever shaft hole 31*h*.

Hereinafter, an axis of the first lever shaft hole 31*h* is also referred to as "a first axis." The first lever 3 is pivotable about the first axis. A shaft section (a virtual shaft) having the first axis functions as an operation input shaft that can input an operation to the tape cutting unit 7 and the vertical driving mechanism 120 (the tape support driving unit 10, see FIG. 9).

As shown in FIG. 2, the second lever 4 extends substantially vertically and is more gently inclined than the first lever 3 to be disposed downward toward the front side. As shown in FIG. 4, the second lever 4 includes a second lever main body 40 and a second lever connecting section 41. The second lever 4 functions as a second operation input unit that can input an operation to a horizontal driving mechanism 130 (a second driving mechanism, see FIG. 12) in the tape support driving unit 10.

A user's finger or the like comes in contact with the second lever main body 40 when the second lever 4 is operated. As shown in FIG. 2, the second lever main body 40 is disposed between front and rear sides of the first lever main body 30 and the grip main body 20. The second lever main body 40 is formed in a plate shape extending such that a horizontal width decreases toward the lower side.

As shown in FIG. 4, the second lever connecting section 41 pivotably supports the second lever 4. The second lever connecting section 41 is disposed on the upper end portion of the second lever 4. A shaft 42 (hereinafter, also referred to as "a second lever shaft 42") extending in the lateral direction is connected to the second lever connecting section 41.

Hereinafter, an axis of the second lever shaft 42 is also referred to as "a second axis." The second lever 4 is pivotable about the second axis. The second lever 4 and the second lever shaft 42 pivot integrally with each other. The second lever shaft 42 functions as an operation input shaft that can input an operation to the feeder 6 and the horizontal driving mechanism 130 (the tape support driving unit 10, see FIG. 12).

The second axis is disposed on the same axis as the first axis. That is, the feeder 6, the tape cutting unit 7 and the tape support driving unit 10 include an operation input shaft disposed on the same axis.

The base 5 will be described.

As shown in FIG. 3, the base 5 is a base configured to support components of the binding mechanism 1. The base 5 is fixed to the grip 2.

The base 5 includes a base block 50 and a mat base 55.

The base block 50 is connected to the base connecting section 22 in the grip 2. The base block 50 is formed in a block shape extending vertically. Four bearing units 51 to 54 are installed on the base block 50.

The bearing units 51 to 54 are portions having through-holes (shaft holes) that open the base block 50 in the lateral direction and in which bearings are installed. The four bearing units 51 to 54 are disposed vertically at intervals. Hereinafter, the four bearing units 51 to 54 are referred to as "the first bearing unit 51," "the second bearing unit 52," "the third bearing unit 53" and "the fourth bearing unit 54" in sequence from the lower side.

A cutter mat 56 is mounted on the mat base 55. The mat base 55 is connected to the upper portion of the base block 50. The mat base 55 extends rightward from the base block 50.

The feeder 6 will be described.

As shown in FIG. 4, the feeder 6 is supported by the base 5. The feeder 6 is interlocked with the second lever 4 and feeds the adhesive tape 15 (see FIG. 2) out.

As shown in FIG. 2, the feeder 6 includes a tape conveyance roller 60, a tape biasing roller 61, a biasing roller support member 62, a tape feeding force transmission mechanism 63, the tape reel 64 and a releasing reel 65.

The tape conveyance roller 60 is disposed behind the mat base 55. The tape conveyance roller 60 is formed in a columnar shape extending in the lateral direction. Hereinafter, an axis of the tape conveyance roller 60 is also referred to as "a feeding roller axis." The tape conveyance roller 60 is interlocked with the second lever 4 and pivots about the feeding roller axis.

The tape biasing roller 61 is disposed above the tape conveyance roller 60. The tape biasing roller 61 faces the tape conveyance roller 60 in the vertical direction. The tape biasing roller 61 is formed in a columnar shape extending leftward and rightward along the tape conveyance roller 60. Hereinafter, an axis of the tape biasing roller 61 is also referred to as "a biasing roller axis." The tape biasing roller 61 follows the tape conveyance roller 60 and pivots about the biasing roller axis.

The biasing roller support member 62 pivotably supports the tape biasing roller 61 about the biasing roller axis. The biasing roller support member 62 biases the tape biasing roller 61 toward the tape conveyance roller 60. The biasing roller support member 62 is pivotably supported by the fourth bearing unit 54 (see FIG. 3). For example, a biasing member (not shown) such as a spring or the like is attached to the biasing roller support member 62.

The tape feeding force transmission mechanism 63 transmits a driving force due to pivotal movement of the second lever 4 to the tape conveyance roller 60. The tape feeding force transmission mechanism 63 functions as an interlocking switching mechanism configured to switch between a process in which the feeder 6 and the tape cutting unit 7 are interlocked and a process in which they are not interlocked.

As shown in FIG. 4, the tape feeding force transmission mechanism 63 includes a first gear 63*a*, a second gear 63*b*, a third gear 63*c*, a fourth gear 63*d*, an intermediate transmission shaft 63*e* and a roller shaft 63*f*.

The first gear 63*a* is disposed on a side opposite to the second lever 4 with the base block 50 sandwiched therebetween. The first gear 63*a* is fixed to the right end portion of the second lever shaft 42. The first gear 63*a* pivots with the second lever shaft 42. The second lever shaft 42 is supported by the first bearing unit 51 (see FIG. 3) to be pivotable about the second lever axis. The second lever connecting section 41 is fixed to the left end portion of the second lever shaft 42.

The intermediate transmission shaft 63*e* extends parallel to the second lever shaft 42 in the lateral direction. The intermediate transmission shaft 63*e* is disposed above the second lever shaft 42. Hereinafter, an axis of the intermediate transmission shaft 63*e* is also referred to as "a transmission intermediate axis." The intermediate transmission shaft 63*e* is supported by the second bearing unit 52 (see FIG. 3) to be pivotable about the transmission intermediate axis.

The second gear 63*b* meshes with the first gear 63*a*. The second gear 63*b* is fixed to the right end portion of the intermediate transmission shaft 63*e*. The second gear 63*b* pivots with the intermediate transmission shaft 63*e*.

The third gear 63*c* is disposed on a side opposite to the second gear 63*b* with the base block 50 sandwiched therebetween. The third gear 63*c* is fixed to a left portion of the intermediate transmission shaft 63*e*. The third gear 63*c* pivots with the intermediate transmission shaft 63*e*.

The roller shaft 63*f* extends parallel to the second lever shaft 42 in the lateral direction. The roller shaft 63*f* is disposed above the intermediate transmission shaft 63*e*. Hereinafter, an axis of the roller shaft 63*f* is also referred to as "a roller axis." The roller axis is the same axis as the feeding roller axis. The roller shaft 63*f* is supported by the third bearing unit 53 (see FIG. 3) to be pivotable about the roller axis. The tape conveyance roller 60 is fixed to the right end portion of the roller shaft 63*f*.

The fourth gear 63*d* is disposed on a side opposite to the tape conveyance roller 60 with the base block 50 sandwiched therebetween. The fourth gear 63*d* meshes with the third gear 63*c*. The fourth gear 63*d* is fixed to the left portion of the roller shaft 63*f* via a clutch 63*g*.

The clutch 63*g* transmits a pivoting force about the roller axis in one direction. For example, the clutch 63*g* is a one-way clutch.

When the fourth gear 63*d* is pivoted in an arrow V1 direction in FIG. 4, since the fourth gear 63*d* is connected to the roller shaft 63*f* via the clutch 63*g*, power is transmitted to the roller shaft 63*f* When power is transmitted to the roller shaft 63*f*, the tape conveyance roller 60 is pivoted with the roller shaft 63*f* in the arrow V1 direction. That is, the tape conveyance roller 60 is pivoted when the second lever 4 is pulled in a direction of approach to the grip 2. Meanwhile, the tape conveyance roller 60 is not pivoted when the second lever 4 returns in a direction away from the grip 2.

As shown in FIG. 2, the tape reel 64 holds a web roll on which a belt-shaped adhesive tape 15 is wound. The tape reel 64 is formed in a columnar shape extending in the lateral direction. Hereinafter, an axis of the tape reel 64 is also referred to as "a reel axis." The tape reel 64 is supported by the reel support section 21 (see FIG. 3) to be pivotable about the reel axis. For example, the left end portion of the tape reel 64 is fitted into the circular hole 21*h* of the reel support section 21 via a bearing (not shown) (see FIG. 3).

As shown in FIG. 2, the adhesive tape 15 includes an adhesive layer 15*a*, a protective film 15*b* and a release film 15*c*. The protective film 15*b* covers one side of the adhesive layer 15*a* in the thickness direction. The release film 15*c* covers the adhesive layer 15*a* from a side opposite to the protective film 15*b*. The release film 15*c* is released from the adhesive layer 15*a* before use of the adhesive tape 15. The exfoliation film 15*c* is wound on the releasing reel 65 via the tape biasing roller 61.

The tape cutting unit 7 will be described.

As shown in FIG. 5, the tape cutting unit 7 is supported by the base 5. The tape cutting unit 7 interlocks the fed adhesive tape 15 (see FIG. 2) with the first lever 3 and cuts the adhesive tape 15.

The tape cutting unit 7 includes a cutter feeding mechanism 70, a cutter guide base 75 and a cutting force transmission mechanism 78.

The cutter feeding mechanism 70 includes a rotary cutter 71, a cutter support bracket 72, a cutter guide rail 73 and a cutter guide block 74.

The rotary cutter 71 is a circular cutting blade. The rotary cutter 71 can cut the fed adhesive tape 15 (see FIG. 2) in the lateral direction. A shaft 71*a* (hereinafter, also referred to as "a cutter shaft 71*a*") extending in the horizontal direction is inserted through the central portion of the rotary cutter 71. The rotary cutter 71 is rotatable about the cutter shaft 71*a*.

The cutter support bracket 72 includes a bracket main body 72*a* and a cutter attachment plate 72*b*.

The bracket main body 72*a* is formed in a plate shape having a vertical thickness. The bracket main body 72*a* is fixed to the cutter guide block 74.

The cutter attachment plate 72*b* extends downward from the front end of the bracket main body 72*a*. The cutter shaft 71*a* is attached to the lower end portion of the cutter attachment plate 72*b*.

The cutter guide rail 73 extends in the lateral direction.

The cutter guide block 74 is supported by the cutter guide rail 73 to be movable in the extending direction of the cutter guide rail 73.

The cutter guide base 75 is a base that supports components of the tape cutting unit 7. The cutter guide base 75 is connected to the upper end portion of the base block 50. The cutter guide base 75 extends in the lateral direction. The left half portion of the cutter guide base 75 supports the cutter guide rail 73 from below. The right half portion of the cutter guide base 75 is longer than an initial length of a first tensile spring 78*q*.

A stopper 76 (see FIG. 6) is installed on the left end portion of the cutter guide base 75. A spring connecting portion 77 is installed on the right end portion of the cutter guide base 75.

The cutting force transmission mechanism 78 performs a storing operation of storing a cutting force in a direction opposite to the cutting direction (the rightward direction) of the adhesive tape 15 (the leftward direction). The cutting force transmission mechanism 78 performs a cutting operation of applying the cutting force in the cutting direction of the adhesive tape 15 after the storing operation. The cutting force transmission mechanism 78 functions as an interlocking switching mechanism configured to switch between a process in which the feeder 6 and the tape cutting unit 7 are interlocked shown in FIG. 2 and a process in which they are not interlocked.

Figure 6:
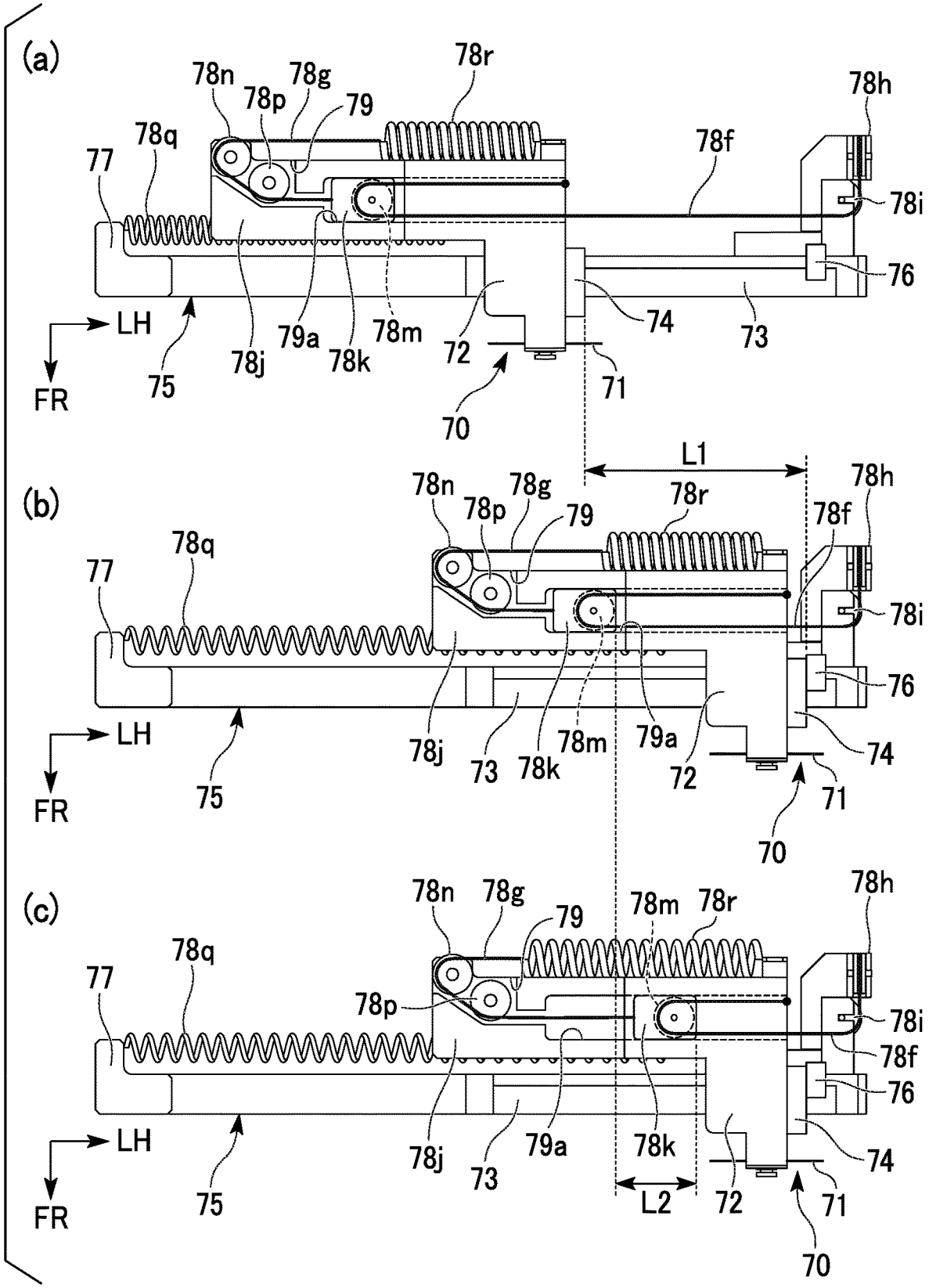
FIG. 6 is a view showing the tape cutting unit according to the embodiment.

As shown in FIG. 5, the cutting force transmission mechanism 78 includes a fifth gear 78*a*, a sixth gear 78*b*, a seventh gear 78*c*, an eighth gear 78*d*, a wire pulley 78*e*, a first wire 78*f*, a second wire 78*g* (see FIG. 6), a first idler 78*h*, a second idler 78*i*, a wire feeding block 78*j*, a moving block 78*k* shown in FIG. 6, a block-side first pulley 78*m*, a block-side second pulley 78*n*, a block-side idler 78*p*, a first biasing member 78*q* and a second biasing member 78*r*.

As shown in FIG. 5, the fifth gear 78*a* is fixed to a left side portion of the upper end portion (the first lever connecting section 31) of the first lever 3. The fifth gear 78*a* pivots with the first lever 3 about the first axis.

The sixth gear 78*b* meshes with the fifth gear 78*a*. The sixth gear 78*b* is supported by the intermediate transmission shaft 63*e* (see FIG. 4) via the bearing to be pivotable about the transmission intermediate axis.

The seventh gear 78*c* is disposed on the left side of the sixth gear 78*b*. The seventh gear 78*c* has a different size from the sixth gear 78*b*. The seventh gear 78*c* is coaxially and integrally connected to the sixth gear 78*b*. The seventh gear 78*c* is supported by the intermediate transmission shaft 63*e* (see FIG. 4) via the bearing to be pivotable about the transmission intermediate axis. The seventh gear 78*c* pivots with the sixth gear 78*b*.

The eighth gear 78*d* meshes with the seventh gear 78*c*. The eighth gear 78*d* is supported by the roller shaft 63*f* (see FIG. 4) via the bearing to be pivotable about the roller axis.

The wire pulley 78*e* is disposed on the left side of the eighth gear 78*d*. The wire pulley 78*e* is coaxially integrally connected to the eighth gear 78*d*. The wire pulley 78*e* is supported by the roller shaft 63*f* (see FIG. 4) via the bearing to be pivotable about the roller axis. The wire pulley 78*e* pivots with the eighth gear 78*d*.

The first wire 78*f* connects the wire pulley 78*e* to the wire feeding block 78*j*. A first end (one end) of the first wire 78*f* is connected to the wire pulley 78*e*. A second end (the other end) of the first wire 78*f* is connected to the wire feeding block 78*j*.

When the wire pulley 78*e* is rotated in an arrow V2 direction in FIG. 5, the first wire 78*f* is wound on the wire pulley 78*e*. That is, the wire pulley 78*e* is rotated in a direction of winding the first wire 78*f* when the first lever 3 is pulled in a direction of approach to the grip 2.

The first idler 78*h* and the second idler 78*i* are attached to the left end portion of the cutter guide base 75.

The first idler 78*h* has a rotary shaft (hereinafter, also referred to as "a first idler shaft") parallel to the lateral direction.

The second idler 78*i* has a rotary shaft (hereinafter, also referred to as "a second idler shaft") parallel to the vertical direction. The first idler shaft and the second idler shaft are at positions of torsion.

The wire feeding block 78*j* is formed in a rectangular shape having a long side in the lateral direction. As shown in FIG. 6(*a*), an accommodating groove 79 configured to accommodate the moving block 78*k*, the block-side second pulley 78*n* and the block-side idler 78*p* is formed in the wire feeding block 78*j*. Hereinafter, a portion of the accommodating groove 79 configured to accommodate the moving block 78*k* is also referred to as "a moving block guide groove 79*a*." The moving block guide groove 79*a* extends in the lateral direction.

The moving block 78*k* is formed in a rectangular shape having a long side in the lateral direction. The moving block 78*k* is movable in the lateral direction along the extending direction of the moving block guide groove 79*a*. The block-side first pulley 78*m* is built into the moving block 78*k*.

The first wire 78*f* bridges the wire pulley 78*e* (see FIG. 5), the first idler 78*h*, the second idler 78*i* and the block-side first pulley 78*m* in sequence from the first end side.

The second wire 78*g* connects the moving block 78*k* and the second biasing member 78*r*. A first end of the second wire 78*g* is connected to the moving block 78*k*. A second end of the second wire 78*g* is connected to the second biasing member 78*r*. The second wire 78*g* bridges the block-side idler 78*p* and the block-side second pulley 78*n* in sequence from the first end side.

The first biasing member 78*q* is a tensile coil spring that can be expanded and contracted in the lateral direction. Hereinafter, the first biasing member 78*q* is also referred to as "the first tensile spring 78*q*." The first tensile spring 78*q* connects the wire feeding block 78*j* and the cutter guide base 75. A first end of the first tensile spring 78*q* is connected to the wire feeding block 78*j*. A second end of the first tensile spring 78*q* is connected to the spring connecting portion 77 in the right end portion of the cutter guide base 75.

The second biasing member 78*r* is a tensile coil spring that can be expanded and contracted in the lateral direction. Hereinafter, the second biasing member 78*r* is also referred to as "a second tensile spring 78*r*." The second tensile spring 78*r* connects the wire feeding block 78*j* and the second wire 78*g*. A first end of the second tensile spring 78*r* is connected to the wire feeding block 78*j*. A second end of the second tensile spring 78*r* is connected to the second end of the second wire 78*g*.

The first tensile spring 78*q* and the second tensile spring 78*r* have different spring constants. In the embodiment, a spring constant K2 of the second tensile spring 78*r* is larger than a spring constant K1 of the first tensile spring 78*q* (K2>K1). That is, the second tensile spring 78*r* is stiffer than the first tensile spring 78*q*.

An operation of the rotary cutter 71 will be described.

FIG. 6(*a*) shows an initial state before the first lever 3 is pulled in a direction of approach to the grip 2. That is, FIG. 6(*a*) shows a state in which the first wire 78*f* is pulled out furthest from the wire pulley 78*e*.

FIG. 6(*b*) shows a state when the first lever 3 has been pulled to a position of the second lever 4 in a direction of approach to the grip 2. Hereinafter, an operation of pulling the first lever 3 to a position of the second lever 4 is also referred to as "a first operation" (an operation in an arrow A1 direction shown in FIG. 2).

FIG. 6(*c*) shows a state when the first lever 3 has been pulled from the position of the second lever 4 to the grip 2 in a direction of approach to the grip 2. Hereinafter, an operation of pulling the first lever 3 from the position of the second lever 4 to the grip 2 is also referred to as "a second operation" (an operation in an arrow A2 direction shown in FIG. 2).

In the first operation, when the first wire 78*f* is wound on the wire pulley 78*e* (see FIG. 5), since the second tensile spring 78*r* is stiffer than the first tensile spring 78*q*, the first tensile spring 78*q* expands before the second tensile spring 78*r* (see FIG. 6(*b*)). As shown in FIG. 6(*b*), when the first tensile spring 78*q* expands, the cutter guide block 74 is moved leftward along the cutter guide rail 73 by a distance L1. The cutter guide block 74 abuts the stopper 76 when moved leftward by the distance L1.

In the second operation, the moving block 78*k* is pulled toward the first wire 78*f* and moved leftward along the moving block guide groove 79*a* by a distance L2. When the second operation is terminated, a state of FIG. 6(*c*) is brought about. In the state of FIG. 6(*c*), the second tensile spring 78*r* is expanded, and the first wire 78*f* is wound on the wire pulley 78*e* (see FIG. 5) by two times the distance L2.

A storing operation of the cutting force transmission mechanism 78 can be performed by the first operation and the second operation. The cutting force transmission mechanism 78 stores a biasing force of the spring as a cutting force in a direction opposite to the cutting direction of the adhesive tape 15.

Hereinafter, an operation of returning the first lever 3 from the grip 2 to the position of the second lever 4 is also referred to as "a third operation" and an operation of returning the first lever 3 from the position of the second lever 4 to its original position (a position of an initial state of the first lever 3) is also referred to as "a fourth operation." The third operation and the fourth operation are operations in a direction away from the grip 2. The third operation is an operation in an arrow A3 direction shown in FIG. 2. The fourth operation is an operation in an arrow A4 direction shown in FIG. 2.

In the third operation, as a recovery force of the second tensile spring 78*r* is applied, and the moving block 78*k* returns to the position in FIG. 6(*b*).

Since the cutter guide block 74 is made to abut the stopper 76 by the first operation, even when the first lever 3 is pulled during the second operation and the third operation, the rotary cutter 71 can be stopped at the position in FIG. 6(*b*).

In the fourth operation, the cutter guide block 74 returns from the position abutting the stopper 76 to the position in FIG. 6(*a*) by applying the recovery force of the first tensile spring 78*q*. As shown in FIG. 6(*a*), the rotary cutter 71 cuts the fed adhesive tape 15 (see FIG. 2) in the lateral direction due to a return of the cutter guide block 74.

The cutting operation of the cutting force transmission mechanism 78 can be performed by the fourth operation. The cutting force transmission mechanism 78 applies a biasing force of the spring as a cutting force in the cutting direction of the adhesive tape 15.

The paper guide 12 will be described.

As shown in FIG. 2, the paper guide 12 guides a paper bundle (not shown) to the tape adhesion unit 8. The paper guide 12 is disposed in front of the mat base 55. As shown in FIG. 1, the paper guide 12 is formed in a U shape that opens downward (an inverted U shape). When seen in a side view of FIG. 2, the paper guide 12 extends to be bent forward and upward after linearly extending upward from the position of the tape adhesion unit 8.

The cover guide 13 will be described.

As shown in FIG. 2, the cover guide 13 serves both for a cover function of the tape adhesion unit 8 and a guide function of the paper bundle.

The cover guide 13 is disposed behind the paper guide 12. The cover guide 13 covers a front portion of the tape adhesion unit 8.

The paper guide 12 and the cover guide 13 face each other in the horizontal direction. An insertion path of the paper bundle is formed between front and rear sides of the paper guide 12 and the cover guide 13. The insertion path of the paper bundle vertically linearly extends toward a space between a first roller 81 and a second roller 82 in the tape adhesion unit 8.

The tape adhesion unit 8 will be described.

As shown in FIG. 2, the tape adhesion unit 8 is supported by a tape holding and driving base 110. The tape adhesion unit 8 attaches the cut adhesive tape 15 (hereinafter, also referred to as "the tape piece 16") to the paper bundle.

The tape adhesion unit 8 includes the first roller 81, the second roller 82 and a roller biasing support section 83.

The first roller 81 and the second roller 82 are formed in columnar shapes extending in the lateral direction. The first roller 81 and the second roller 82 face each other in the horizontal direction.

The roller biasing support section 83 pivotably supports the first roller 81 and the second roller 82. The roller biasing support section 83 biases the first roller 81 and the second roller 82 in a direction in which they approach each other.

For example, an edge portion of a paper bundle is inserted between the first roller 81 and the second roller 82 together with the tape piece 16. Then, the first roller 81 and the second roller 82 are pushed against the paper bundle and moved in a direction away from each other against the biasing force of the roller biasing support section 83. That is, the first roller 81 and the second roller 82 push the tape piece 16 against the edge portion of the paper bundle. Accordingly, the tape piece 16 can be adhered to the edge portion of the paper bundle.

The tape support units 9 will be described.

Figure 14:
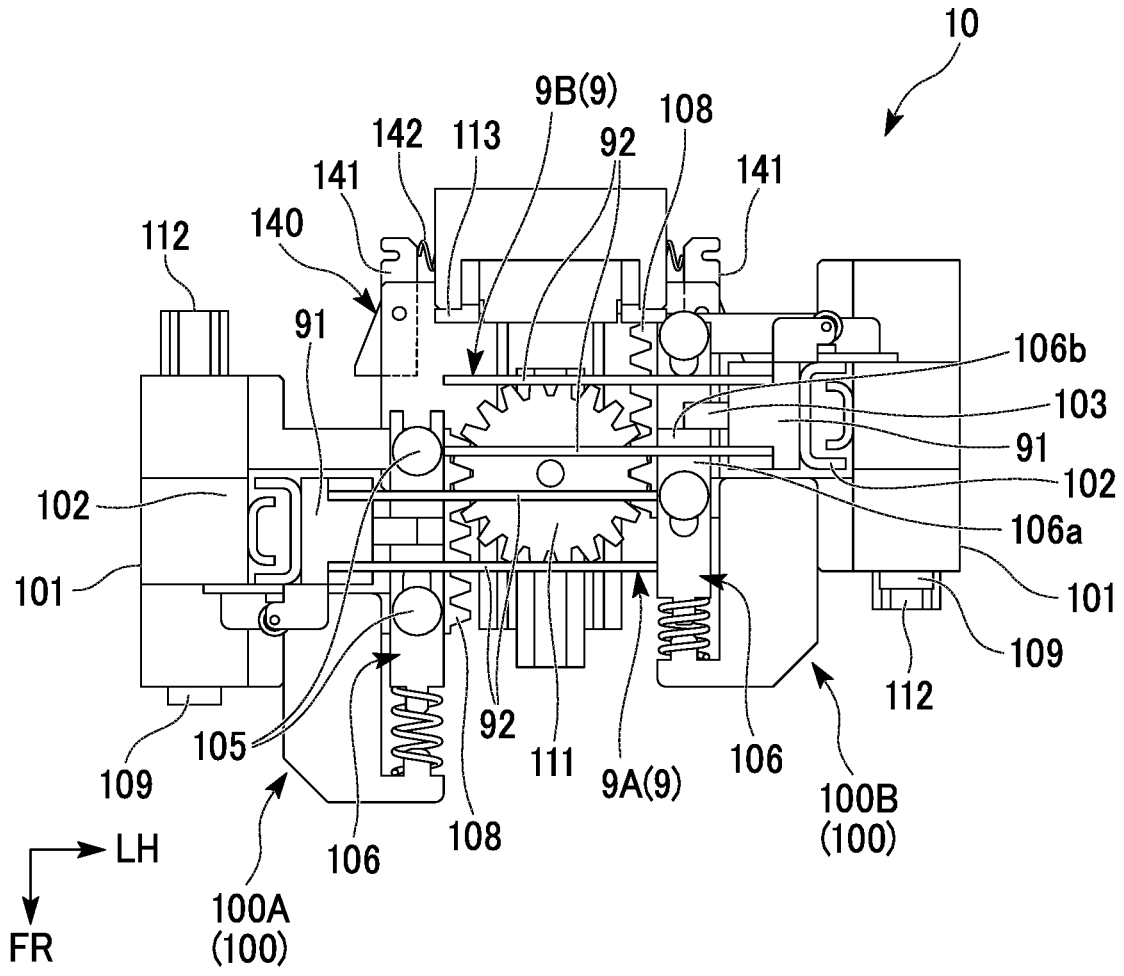
FIG. 14 is a plan view of the tape support driving unit according to the embodiment.

As shown in FIG. 2, the tape support units 9 can hold the fed adhesive tape 15. As shown in FIG. 14, the tape support units 9 are installed on left and right sides as a pair. The pair of left and right tape support units 9 are separated from each other on front and rear sides. Hereinafter, in the pair of tape support units 9, the tape holding unit 9 disposed on the right side (hereinafter, also referred to as "the first tape holding unit 9A") will be described. Since the tape holding unit 9 (hereinafter, also referred to as "the second tape holding unit 9B") disposed on the left side has the same configuration as the first tape holding unit 9A, detailed description thereof will be omitted.

Figure 7:
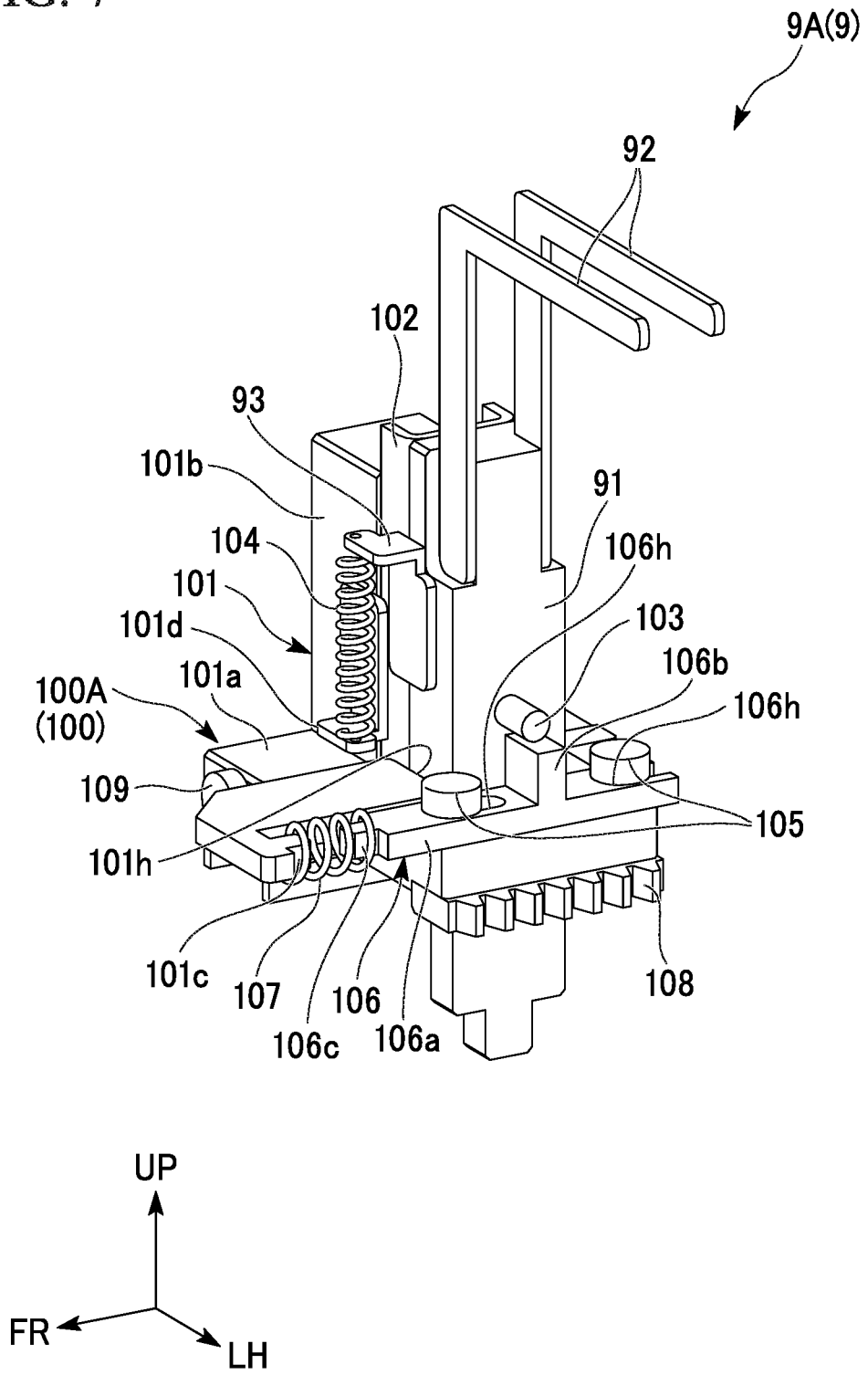
FIG. 7 is a perspective view of a tape holding unit according to the embodiment.

FIG. 7 is a perspective view of the tape holding unit 9 according to the embodiment.

As shown in FIG. 7, the first tape holding unit 9A (the tape holding unit 9) includes a column 91 and a holding plate 92.

The column 91 is formed in a rectangular shape extending in the vertical direction. A spring upper end locking member 93 is attached to the front surface of the column 91.

The holding plate 92 is fixed to the upper end portion of the column 91. The holding plate 92 is formed in an L shape that has a upright portion extending from the upper end portion of the column 91 and a lateral portion connected to the upper portion of the upright portion and extending inward in the lateral direction.

The holding plates 92 are installed on front and rear sides as a pair. The pair of holding plates 92 are separated from each other such that the paper bundle can be inserted therebetween. The pair of holding plates 92 are disposed on front and rear sides in parallel with an interval therebetween. As shown in FIG. 14, the pair of tape support units 9 are always separated from each other on front and rear sides such that the holding plates 92 do not overlap each other.

The tape support driving unit 10 will be described.

As shown in FIG. 2, the tape support driving unit 10 is interlocked with the levers 3 and 4 to drive the pair of tape support units 9. The tape support driving unit 10 simultaneously holds the fed adhesive tape 15 using the pair of tape support units 9 and provides the adhesive tape 15 to the tape adhesion unit 8.

The tape support driving unit 10 drives the pair of tape support units 9 such that the tape cutting unit 7 can cut the adhesive tape 15 between the holding sections of the adhesive tape 15 when the adhesive tape 15 is pressed by the pair of tape support units 9. The tape support driving unit 10 can move the pair of tape support units 9 in a feeding direction (a forward direction) of the adhesive tape 15. The tape support driving unit 10 can move the pair of tape support units 9 in the vertical direction and the horizontal direction. The tape support driving unit 10 alternately drives the pair of tape support units 9 in the vertical direction such that the pair of tape support units 9 pass each other in the horizontal direction alternately.

Figure 12:
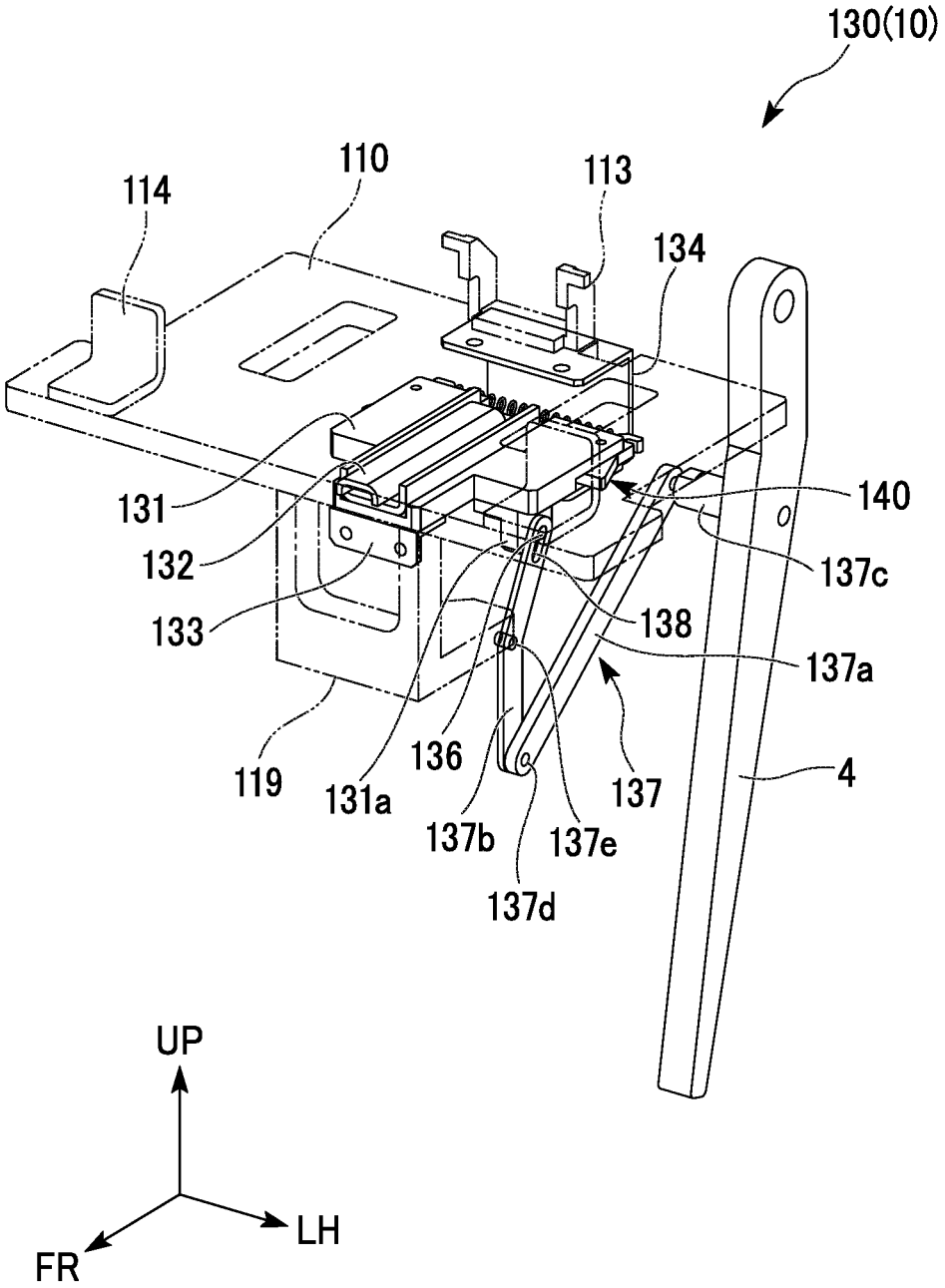
FIG. 12 is a perspective view of a horizontal driving mechanism according to the embodiment.

As shown in FIG. 14, the tape support driving unit 10 includes support mechanisms 100, the tape holding and driving base 110 (see FIG. 8), the vertical driving mechanism 120 (a first driving mechanism, see FIG. 9) and the horizontal driving mechanism 130 (a second driving mechanism, see FIG. 12).

The support mechanisms 100 will be described.

As shown in FIG. 14, the support mechanisms 100 support the pair of tape support units 9. The support mechanisms 100 are installed on left and right sides as a pair. The left and right support mechanisms 100 are disposed at different positions in the horizontal direction. Hereinafter, in the pair of support mechanisms 100, the support mechanism 100A (hereinafter, also referred to as "the first support mechanism 100A") disposed on the right side will be described. Since the support mechanism 100B (hereinafter, also referred to as "the second support mechanism 100B") disposed on the left side has the same configuration as the first support mechanism 100A, detailed description thereof will be omitted.

In FIG. 7, in addition to the first tape holding unit 9A, the first support mechanism 100A is shown.

As shown in FIG. 7, the first support mechanism 100A (a support mechanism) includes a tape holding block 101, a vertical slide guide 102, a vertical positioning pin 103, a vertical biasing member 104, guide pins 105, a horizontal slider 106, a horizontal biasing member 107, a rack 108 and a magnet 109.

The tape holding block 101 includes a holding block main body 101*a* and a holding post 101*b*.

The holding block main body 101*a* is formed in a block shape having a thickness in the vertical direction. A through-hole 101*h* (hereinafter, also referred to as "a column insertion hole 101*h*") that vertically opens and through which the column 91 can be inserted is formed in the holding block main body 101*a*. A spring front end locking claw 101*c* is installed on a front portion of the holding block main body 101*a*.

The holding post 101*b* is formed in a post shape standing upward from the holding block main body 101*a*. A spring lower end locking piece 101*d* is formed on a lower front surface of the holding post 101*b*.

The vertical slide guide 102 guides the column 91 to the tape holding block 101 in the vertical direction. The vertical slide guide 102 is installed between the column 91 and the holding post 101*b*.

The vertical positioning pin 103 is a pin configured to fix the column 91 at a predetermined vertical position. The vertical positioning pin 103 is formed in a columnar shape protruding from the column 91 toward the inside in the lateral direction.

The vertical biasing member 104 biases the column 91 downward toward the tape holding block 101. The vertical biasing member 104 is a tensile coil spring that can expand and contract in the vertical direction. Hereinafter, the vertical biasing member 104 is also referred to as "a vertical tensile/compression spring 104." The vertical tensile/compression spring 104 connects the column 91 and the tape holding block 101. An upper end of the vertical tensile/compression spring 104 is connected to the column 91 via the spring upper end locking member 93. A lower end of the vertical tensile/compression spring 104 is connected to the holding post 101*b* via the spring lower end locking piece 101*d*.

The guide pins 105 guide the horizontal slider 106 to the tape holding block 101 in the horizontal direction. The guide pins 105 are formed in columnar shapes standing upward from the holding block main body 101*a*. The guide pins 105 are installed on front and rear sides as a pair.

The horizontal slider 106 is movable with respect to the tape holding block 101 in the horizontal direction. The horizontal slider 106 includes a slider main body 106*a* and an upward protrusion 106*b*.

The slider main body 106*a* is formed in a plate shape having a thickness in the vertical direction. Through-holes 106*h* (hereinafter, also referred to as "pin holes 106*h*") that vertically open and through which the guide pins 105 can be inserted are formed in the slider main body 106*a*. The pin holes 106*h* extend in the horizontal direction. The pin holes 106*h* set a moving range of the horizontal slider 106 in the horizontal direction. The pin holes 106*h* are formed on front and rear sides as a pair. A spring rear end locking claw 106*c* is installed on a front end of the slider main body 106*a*.

The upward protrusion 106*b* protrudes upward from the slider main body 106*a*. The upward protrusion 106*b* is disposed between front and rear sides of the pair of front and rear pin holes 106*h*. The upward protrusion 106*b* can support the vertical positioning pin 103 from below. That is, the vertical positioning pin 103 can ride on the upper surface of the upward protrusion 106*b*.

The horizontal biasing member 107 biases the horizontal slider 106 rearward with respect to the tape holding block 101. The horizontal biasing member 107 is a compression coil spring that can be expanded and contracted in the horizontal direction. Hereinafter, the horizontal biasing member 107 is also referred to as "the forward/rearward tensile/compression spring 107." The forward/rearward tensile/compression spring 107 connects the horizontal slider 106 and the tape holding block 101. A front end of the forward/rearward tensile/compression spring 107 is connected to the holding block main body 101*a* via the spring front end locking claw 101*c*. A rear end of the forward/rearward tensile/compression spring 107 is connected to the horizontal slider 106 via the spring rear end locking claw 106*c*.

The rack 108 meshes with a pinion 111 (see FIG. 14). The rack 108 is attached to the tape holding block 101. The rack 108 is disposed on a lower portion of an inner end of the holding block main body 101*a* in the lateral direction.

The magnet 109 is attached to the tape holding block 101. The magnet 109 is disposed on an outer front end of the holding block main body 101*a* in the lateral direction. The magnet 109 is formed in a disk shape. The magnet 109 has a contact surface that can come in contact with suction plates 114 (see FIG. 8).

The tape holding and driving base 110 will be described.

Figure 8:
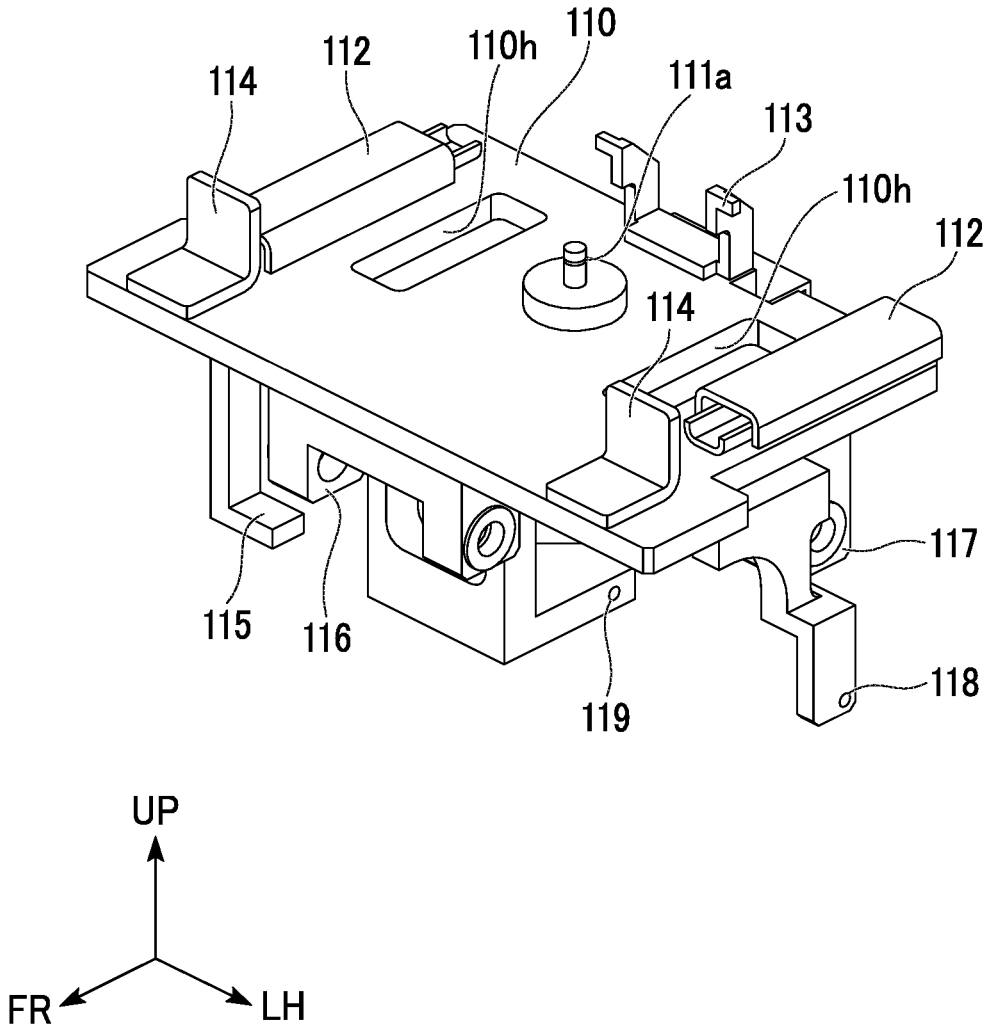
FIG. 8 is a perspective view of a tape holding and driving base according to the embodiment.

FIG. 8 is a perspective view of the tape holding and driving base 110 according to the embodiment.

As shown in FIG. 8, the tape holding and driving base 110 is a base configured to support components of the tape support driving unit 10. The tape holding and driving base 110 is disposed below the mat base 55 (see FIG. 2). The tape holding and driving base 110 is formed in a plate shape having a thickness in the vertical direction.

Through-holes 110*h* vertically passing through the tape holding and driving base 110 are formed in the tape holding and driving base 110. The through-holes 110*h* are disposed on left and right sides of a pinion shaft 111*a* as a pair. The through-holes 110*h* are formed in a rectangular shape having a long side in the horizontal direction. Hereinafter, the through-hole 110*h* in the tape holding and driving base 110 is referred to as "a rectangular hole 110*h*." The column 91 (see FIG. 7) is inserted through the rectangular hole 110*h*. The rectangular hole 110*h* has a sufficient size to allow forward/rearward movement of the column 91.

The pinion shaft 111*a*, horizontal slider guides 112, a slider stopper 113, the suction plates 114, a spring lower end connecting member 115, a first vertical driving bearing unit 116, a second vertical driving bearing unit 117, a third vertical driving bearing unit 118 and a horizontal driving bearing unit 119 are installed on the tape holding and driving base 110.

The pinion shaft 111*a* stands upward from a central portion of the upper surface of the tape holding and driving base 110. The pinion shaft 111*a* pivotably supports the pinion 111 (see FIG. 14). As shown in FIG. 14, a rack and pinion mechanism is constituted by the rack 108 of the holding block main body 101*a* and the pinion 111 of the tape holding and driving base 110.

As shown in FIG. 8, the horizontal slider guides 112 guide the tape holding block 101 (see FIG. 7) to the tape holding and driving base 110 in the horizontal direction. The horizontal slider guides 112 are installed between the holding block main body 101*a* (see FIG. 7) and the tape holding and driving base 110. The horizontal slider guides 112 are installed on both sides of the tape holding and driving base 110 in the lateral direction as a pair.

The slider stopper 113 restricts rearward movement of the horizontal slider 106 (see FIG. 7). The slider stopper 113 stands upward from the rear end of the tape holding and driving base 110. As shown in FIG. 14, the slider stopper 113 is installed at a position where the slider stopper 113 can come in contact with the pair of left and right horizontal sliders 106.

As shown in FIG. 8, the suction plates 114 can be suctioned to a contact surface of the magnet 109 (see FIG. 7). The suction plates 114 are formed in an L shape that has a base portion extending rearward from the front end of the tape holding and driving base 110 and a upright portion connected to the rear portion of the base portion and extending upward. For example, the suction plates 114 are formed of a metal such as iron or the like. The suction plates 114 are attached to a front upper surface of the tape holding and driving base 110. The suction plates 114 are disposed in front of the horizontal slider guides 112. The suction plates 114 are installed at a position where the suction plates 114 can come in contact with the contact surface of the magnet 109.

The spring lower end connecting member 115 is attached to the lower surface of the tape holding and driving base 110. The spring lower end connecting member 115 is formed in an L shape that has a extend portion extending downward from the tape holding and driving base 110 and a lateral portion connected to the lower portion of the downright portion and extending leftward.

The first vertical driving bearing unit 116 pivotably supports a main shaft 121 (see FIG. 9) in the vertical driving mechanism 120. The first vertical driving bearing unit 116 is attached to the front lower surface of the tape holding and driving base 110. The first vertical driving bearing unit 116 is formed in a U shape that opens downward (an inverted U shape). The first vertical driving bearing unit 116 includes a pair of left and right bearing units that protrude downward. The pair of left and right bearing units pivotably support the main shaft 121 via bearings.

The second vertical driving bearing unit 117 pivotably supports a connecting shaft 126*f* (see FIG. 9) in the vertical driving mechanism 120. The second vertical driving bearing unit 117 is attached to a rear lower surface of the tape holding and driving base 110. The second vertical driving bearing unit 117 extends rearward from the tape holding and driving base 110. A lower end portion of the second vertical driving bearing unit 117 pivotably supports the connecting shaft 126*f* via a bearing.

The third vertical driving bearing unit 118 pivotably supports a fourth link 126*d* (see FIG. 9) in the vertical driving mechanism 120. The third vertical driving bearing unit 118 is attached to a left lower surface of the tape holding and driving base 110. The third vertical driving bearing unit 118 is formed in a crank shape that has a first extend portion extending downward from the tape holding and driving base 110, lateral portion connected to the lower portion of the first extend portion and extending leftward, and a second extend portion connected to the left portion of the lateral portion and extending downward. The third vertical driving bearing unit 118 pivotably supports a vertical intermediate portion of the fourth link 126*d* via a pivot pin or the like.

The horizontal driving bearing unit 119 pivotably supports a horizontal driving central shaft 137*e* (see FIG. 12) in the horizontal driving mechanism 130. The horizontal driving bearing unit 119 is attached to a front lower surface of the tape holding and driving base 110. The horizontal driving bearing unit 119 is disposed behind the first vertical driving bearing unit 116. The horizontal driving bearing unit 119 is formed in an L shape that has a extend portion extending downward from the tape holding and driving base 110 and a rear portion connected to the lower portion of the extend portion and extending rearward. The horizontal driving bearing unit 119 pivotably supports the horizontal driving central shaft 137*e* via a bearing.

The vertical driving mechanism 120 will be described.

Figure 9:
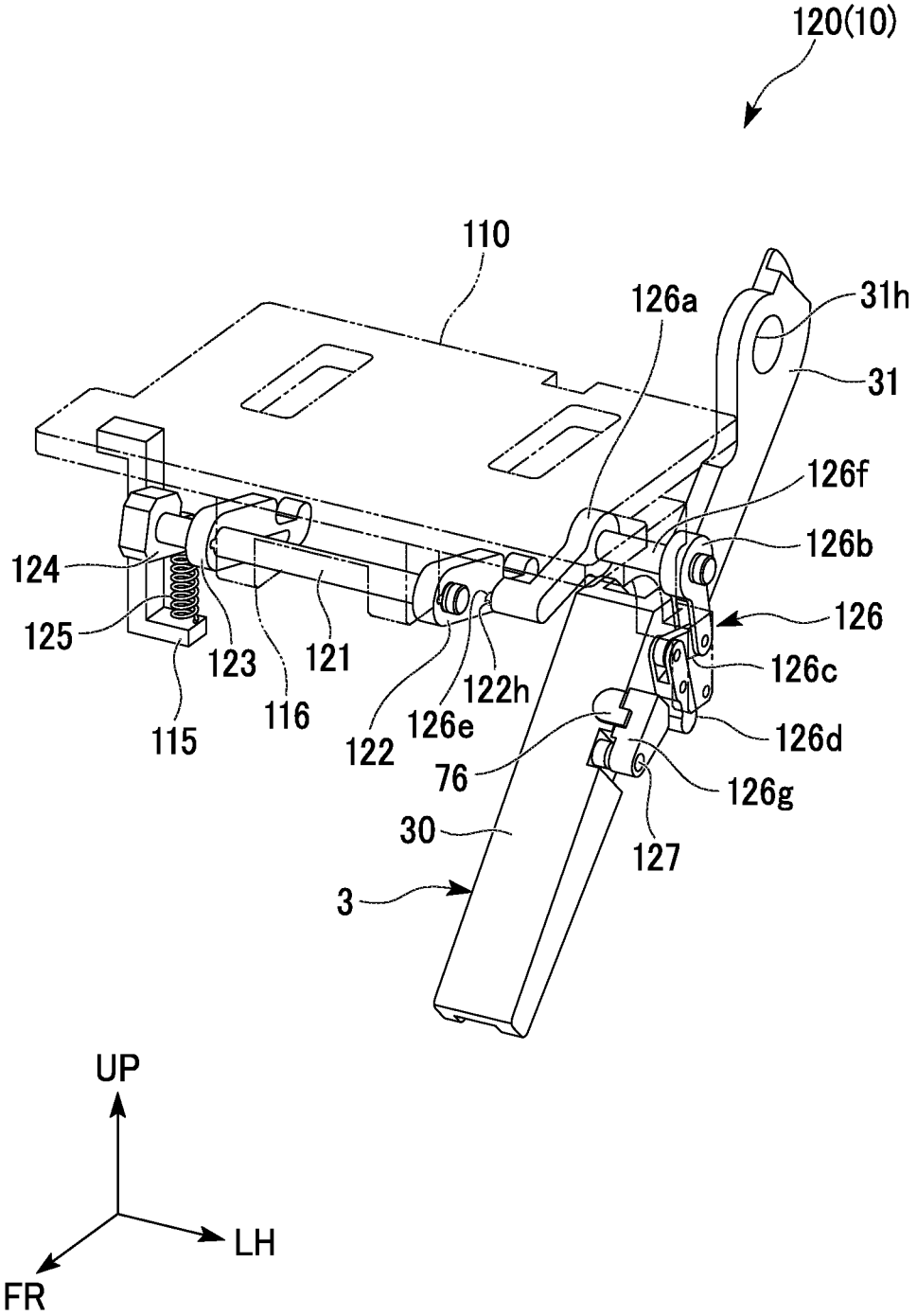
FIG. 9 is a perspective view of a vertical driving mechanism according to the embodiment.
Figure 10:
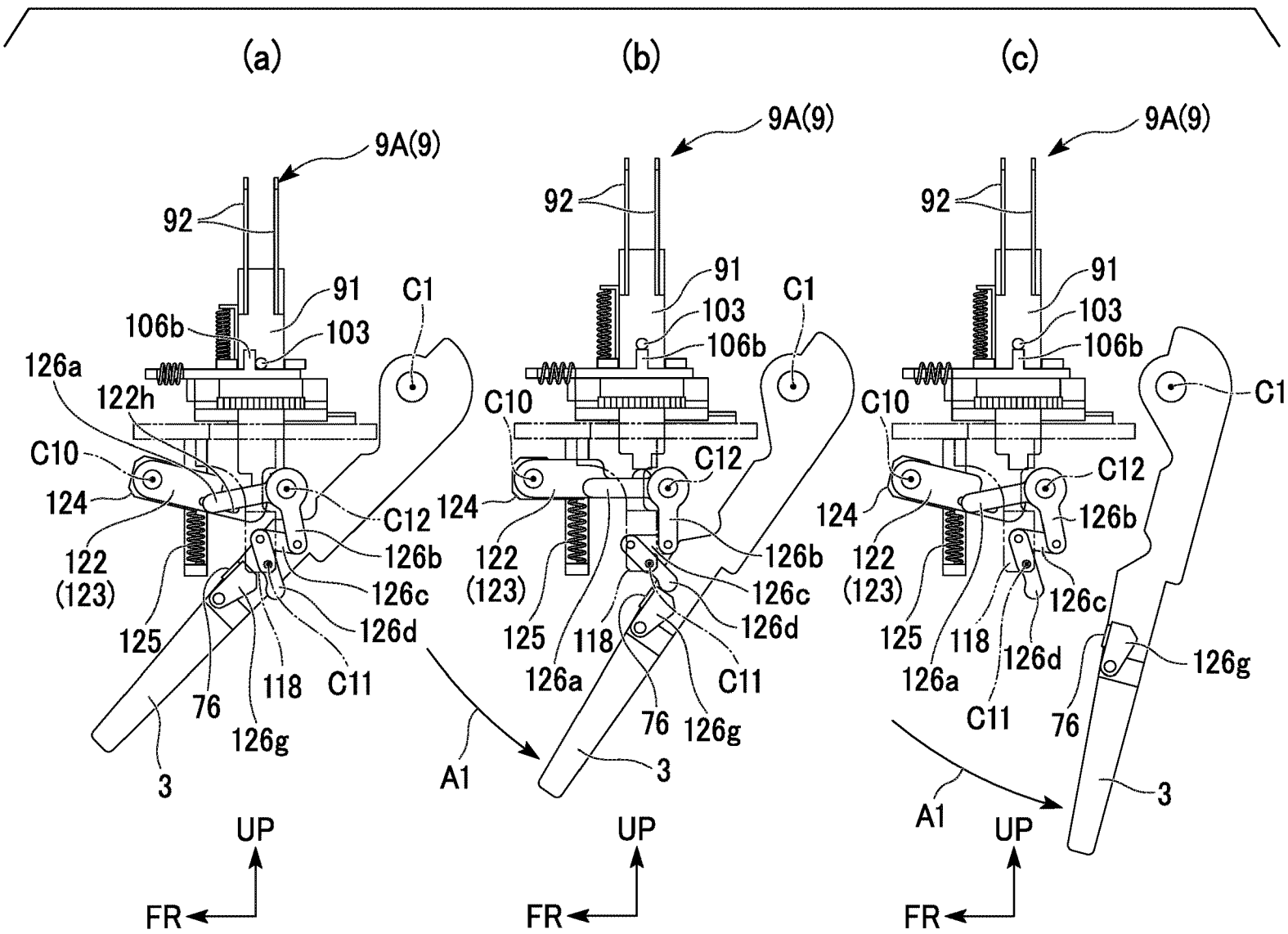
FIG. 10 is a view showing the vertical driving mechanism according to the embodiment.
Figure 11:
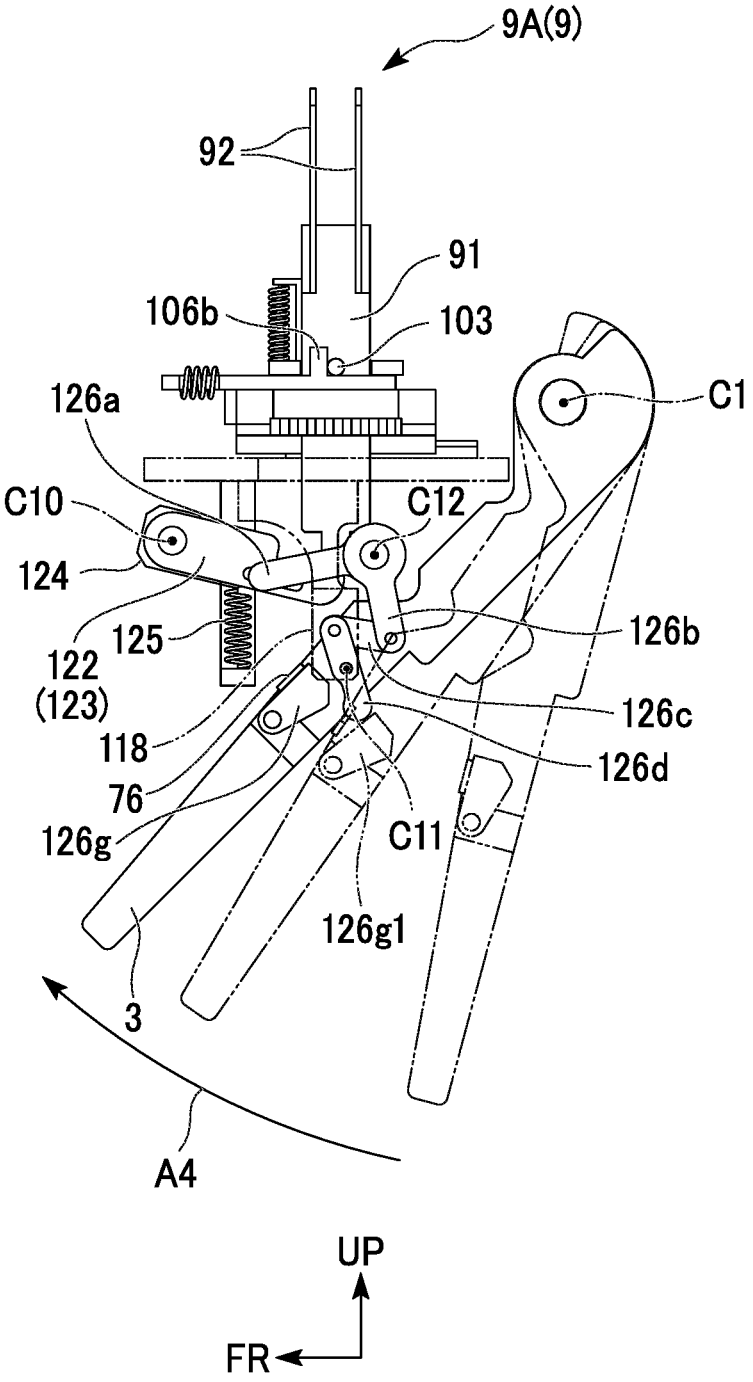
FIG. 11 is a view for explaining an operation of the vertical driving mechanism according to the embodiment.

FIG. 9 is a perspective view of the vertical driving mechanism 120 according to the embodiment. FIG. 10 is a view showing the vertical driving mechanism 120 according to the embodiment. FIG. 10(*a*) is a side view of the vertical driving mechanism 120 according to the embodiment. FIG. 10(*b*) and FIG. 10(*c*) are views for explaining an operation of the vertical driving mechanism 120 according to the embodiment. FIG. 11 is a view for explaining an operation of the vertical driving mechanism 120 according to the embodiment. In FIG. 10(*a*), an initial state of the vertical driving mechanism 120 is shown. In FIG. 10 and FIG. 11, the first tape holding unit 9A is shown. Reference characters C1 in FIG. 10 and FIG. 11 designate an axis (a first axis) of the first lever shaft hole 31*h*.

As shown in FIG. 9, the vertical driving mechanism 120 can drive the pair of tape support units 9 (see FIG. 7) in the vertical direction. The vertical driving mechanism 120 includes the main shaft 121, arms 122 and 123, a spring upper end connecting member 124, a vertical driving biasing member 125 and a vertical driving link mechanism 126.

The main shaft 121 is formed in a columnar shape extending in the lateral direction. The main shaft 121 is pivotably supported by the first vertical driving bearing unit 116. Reference character C10 in FIG. 10 and FIG. 11 designates an axial center of the main shaft 121.

The arms 122 and 123 are fixed to the main shaft 121. The arms 122 and 123 are installed on left and right sides as a pair. The arms 122 and 123 extend rearward from the main shaft 121. At an initial position in FIG. 10(*a*), the arms 122 and 123 (in the drawings, only the left arm 122 is shown) extend forward and rearward to be disposed downward toward the rear side. An elongated hole 122*h* (hereinafter, also referred to as "an arm hole 122*h*") is formed in the left arm 122 extending in the extending direction of the arm 122.

As shown in FIG. 9, the spring upper end connecting member 124 is fixed to a right end portion of the main shaft 121. The spring upper end connecting member 124 extends rearward from the main shaft 121. The pair of arms 122 and 123, the spring upper end connecting member 124 and the main shaft 121 pivot integrally with each other.

The vertical driving biasing member 125 biases the arms 122 and 123 downward with respect to the tape holding and driving base 110 together with the spring upper end connecting member 124. The vertical driving biasing member 125 is a tensile coil spring that can expand and contract vertically. Hereinafter, the vertical driving biasing member 125 is also referred to as "the vertical driving spring 125." The vertical driving spring 125 connects the spring upper end connecting member 124 and the spring lower end connecting member 115. An upper end of the vertical driving spring 125 is connected to the spring upper end connecting member 124. A lower end of the vertical driving spring 125 is connected to the spring lower end connecting member 115.

The vertical driving link mechanism 126 includes a first link 126*a*, a second link 126*b*, a third link 126*c*, the fourth link 126*d*, a link pin 126*e*, the connecting shaft 126*f* and a trigger 126*g*.

At an initial position in FIG. 10(*a*), the first link 126*a* is inclined and extends substantially forward and rearward direction so that the frontend of the first link 126*a* is located at the lower side and the rearend of the first link 126*a* is located at the upper side.

The second link 126*b* extends in a direction crossing the extending direction of the first link 126*a*. At the initial position in FIG. 10(*a*), the second link 126*b* is inclined and extends substantially vertical direction so that the lowerend of the second link 126*b* is located at the rear side and the upperend of the second link 126*b* is located at the front side.

The third link 126*c* extends in a direction crossing the extending direction of the second link 126*b*. At the initial position in FIG. 10(*a*), the third link 126*c* is inclined and extends substantially forward and rearward direction so that the frontend of the third link 126*c* is located at the upper side and the rearend of the third link 126*c* is located at the lower side. A rear end portion of the third link 126*c* is pivotably connected to the lower end portion of the second link 126*b*.

The fourth link 126*d* extends in a direction crossing the extending direction of the third link 126*c*. At the initial position in FIG. 10(*a*), the fourth link 126*d* is inclined and extends substantially vertical direction so that the lowerend of the fourth link 126*d* is located at the rear side and the upperend of the fourth link 126*d* is located at the front side. An upper end portion of the fourth link 126*d* is pivotably connected to the front end portion of the third link 126*c*. A vertical intermediate portion of the fourth link 126*d* is pivotably supported by the third vertical driving bearing unit 118. Reference character C11 in FIG. 10 and FIG. 11 designates a pivotal center of the vertical intermediate portion of the fourth link 126*d*.

As shown in FIG. 9, the link pin 126*e* is formed in a columnar shape extending in the lateral direction. A left end portion of the link pin 126*e* is fixed to the front end portion of the first link 126*a*. A right end portion of the link pin 126*e* is inserted through the arm hole 122*h*. The link pin 126*e* is movable along the arm hole 122*h*.

The connecting shaft 126*f* is formed in a columnar shape extending in the lateral direction. A left end portion of the connecting shaft 126*f* is fixed to the upper end portion of the second link 126*b*. A right end portion of the connecting shaft 126*f* is fixed to the rear end portion of the first link 126*a*. The connecting shaft 126*f* is pivotably supported by the second vertical driving bearing unit 117 (see FIG. 8). The first link 126*a*, the second link 126*b* and the connecting shaft 126*f* pivot integrally with each other. Reference character C12 in FIG. 10 and FIG. 11 designates an axial center of the connecting shaft 126*f*.

The trigger 126*g* is pivotably supported by the first lever 3 with a shaft 127 parallel to an axis (a first axis) of the first lever shaft hole 31*h*. The stopper 76 is attached to the first lever 3. The trigger 126*g* is biased toward the stopper 76 by a biasing member (not shown) such as a spring or the like.

An action of the vertical driving mechanism 120 will be described.

In the initial state of FIG. 10(*a*), the arms 122 and 123 are biased downward.

When the first lever 3 is pulled in the first operation, the trigger 126*g* pushes the lower end portion of the fourth link 126*d* rearward (see FIG. 10(*b*)). Then, as shown in FIG. 10(*b*), the fourth link 126*d*, the third link 126*c*, the second link 126*b* and the first link 126*a* are interlocked to push the arms 122 and 123 upward. Here, the rear end portion of the arm 123 abuts the lower end of the column 91 to push the column 91 upward. Then, the vertical positioning pin 103 rides on the upper surface of the upward protrusion 106*b*. Accordingly, the pair of holding plates 92 are set at an upper position.

Further, when the first lever 3 is pulled in the first operation, the trigger 126*g* is separated from the fourth link 126*d* (see FIG. 10(*c*)). Then, as shown in FIG. 10(*c*), the arms 122 and 123 are returned downward by an action of the vertical driving spring 125. The first operation is an operation in the arrow A1 direction shown in FIG. 10.

As shown in FIG. 11, when the first lever 3 returns in the fourth operation, the lower end portion of the fourth link 126*d* comes in contact with the trigger 126*g*, and the trigger 126*g* is pivoted downward (see reference numeral 126*g*1 in FIG. 11). Here, since a posture of the fourth link 126*d* has not varied, the arms 122 and 123 are not operated. At the end of the fourth operation, the lower end portion of the fourth link 126*d* is separated from the trigger 126*g* (see a solid line in FIG. 11). Accordingly, the trigger 126*g* is biased toward the stopper 76 by an action of the biasing member (not shown) and returned to its original posture. The fourth operation is an operation in the arrow A4 direction shown in FIG. 11.

The horizontal driving mechanism 130 will be described.

Figure 13:
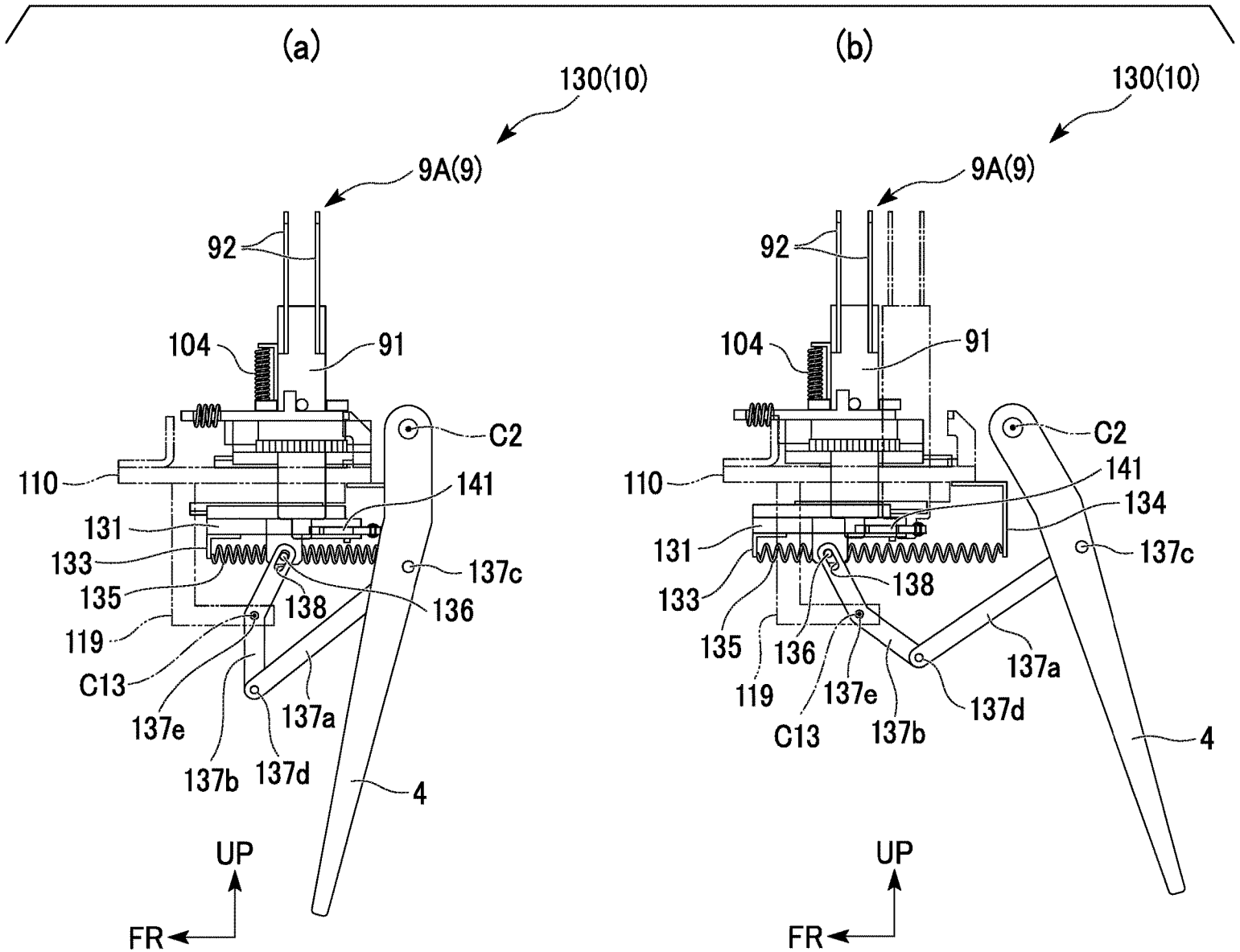
FIG. 13 is a view showing the horizontal driving mechanism according to the embodiment.
Figure 15:
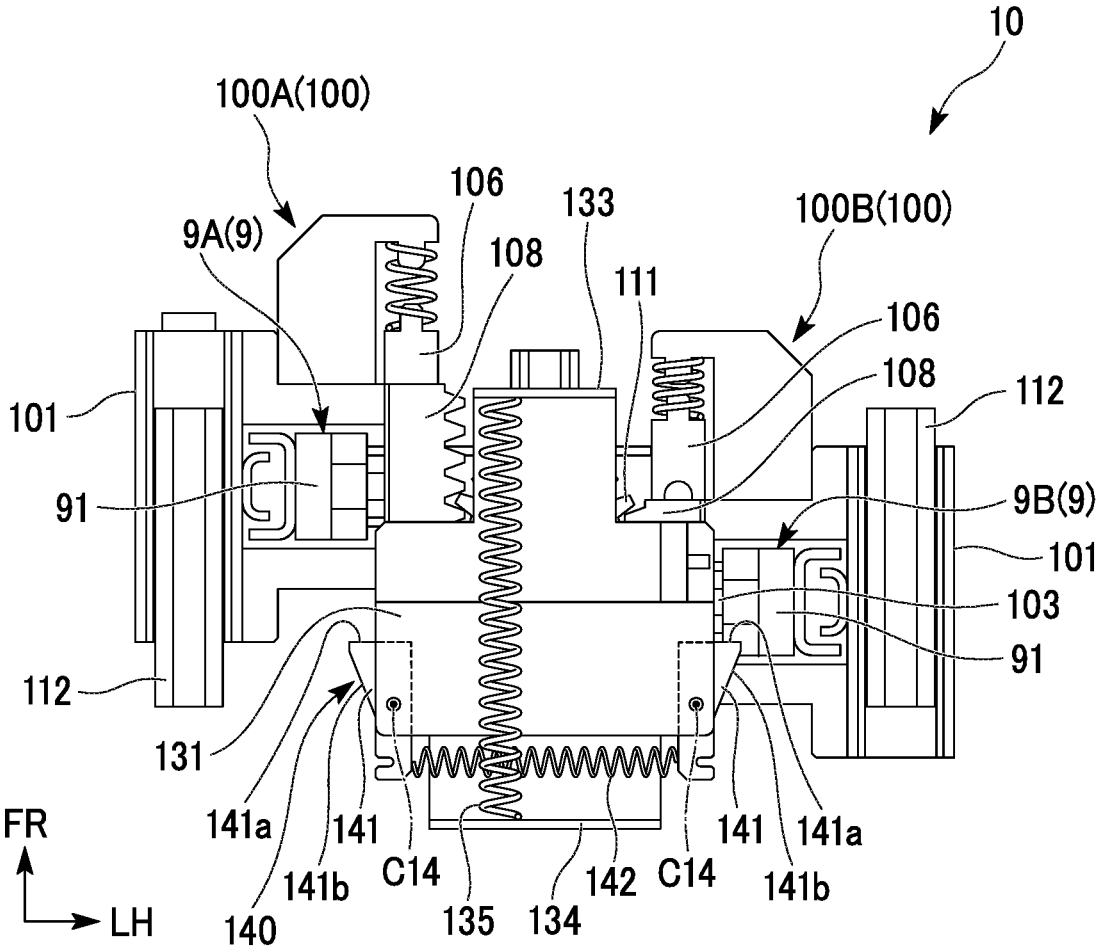
FIG. 15 is a bottom view of the tape support driving unit according to the embodiment.

FIG. 12 is a perspective view of the horizontal driving mechanism 130 according to the embodiment. FIG. 13 is a view showing the horizontal driving mechanism 130 according to the embodiment. FIG. 13(*a*) is a side view of the horizontal driving mechanism 130 according to the embodiment. FIG. 13(*b*) is a view for explaining an operation of the horizontal driving mechanism 130 according to the embodiment. FIG. 14 is a plan view of the tape support driving unit 10 according to the embodiment. FIG. 15 is a bottom view of the tape support driving unit 10 according to the embodiment. In FIG. 13, the first tape holding unit 9A is shown. Reference character C2 in FIG. 13 designates an axis (a second axis) of the second lever shaft 42.

As shown in FIG. 12, the horizontal driving mechanism 130 can drive the pair of tape support units 9 (see FIG. 14) in the horizontal direction. The horizontal driving mechanism 130 includes a horizontal driving base 131, a horizontal driving guide 132, a spring front end connecting member 133, a spring rear end connecting member 134, a horizontal driving biasing member 135 (see FIG. 15), a horizontal driving pin 136, a horizontal driving link mechanism 137 and an engagement mechanism 140.

The horizontal driving base 131 has a plate shape having a thickness in the vertical direction. The horizontal driving base 131 is disposed below the tape holding and driving base 110. A pin support member 131*a* that supports the horizontal driving pin 136 is attached to a left lower surface of the horizontal driving base 131.

The horizontal driving guide 132 guides the horizontal driving base 131 to the tape holding and driving base 110 in the horizontal direction. The horizontal driving guide 132 is installed between the horizontal driving base 131 and the tape holding and driving base 110. The horizontal driving guide 132 is installed at a central portion of the horizontal driving base 131 in the lateral direction.

The spring front end connecting member 133 is fixed to a lower surface of the front end portion of the horizontal driving base 131. The spring front end connecting member 133 is formed in an L shape that has a base portion extending forward along a lower surface of the horizontal driving base 131 and a extend portion connected to the front portion of the base portion and extending downward.

The spring rear end connecting member 134 is fixed to a lower surface of the rear end portion of the tape holding and driving base 110. The spring rear end connecting member 134 is formed in an L shape that has a base portion extending rearward along a lower surface of the tape holding and driving base 110 and a extend portion connected to the rear portion of the base portion and extending downward.

The horizontal driving biasing member 135 (see FIG. 15) biases the horizontal driving base 131 rearward with respect to the tape holding and driving base 110. The horizontal driving biasing member 135 is a tensile coil spring that can be expanded and contracted forward and rearward. Hereinafter, the horizontal driving biasing member 135 is also referred to as "the horizontal driving spring 135." As shown in FIG. 15, a front end of the horizontal driving spring 135 is connected to the spring front end connecting member 133. A rear end of the horizontal driving spring 135 is fixed to the spring rear end connecting member 134.

As shown in FIG. 12, the horizontal driving link mechanism 137 transmits a driving force due to pivotal movement of the second lever 4 to the horizontal driving base 131.

The horizontal driving link mechanism 137 includes a first horizontal driving link 137*a*, a second horizontal driving link 137*b*, a first horizontal driving shaft 137*c*, a second horizontal driving shaft 137*d* and the horizontal driving central shaft 137*e*.

The first horizontal driving link 137*a* is disposed on the right side of the second lever 4. At an initial position of FIG. 13(*a*), the first horizontal driving link 137*a* is inclined and extends substantially forward and rearward direction so that the frontend of the first horizontal driving link 137*a* is located at the lower side and the rearend of the first horizontal driving link 137*a* is located at the upper side.

At the initial position of FIG. 13(*a*), the second horizontal driving link 137*b* extends to be inclined to be disposed upward toward the rear side after extending upward from the front lower end of the first horizontal driving link 137*a*. An elongated hole 138 (hereinafter, also referred to as "a second horizontal driving link hole 138") extending in the extending direction of the upper portion of the second horizontal driving link 137*b* is formed in the upper portion of the second horizontal driving link 137*b*.

The first horizontal driving shaft 137*c* is formed in a columnar shape extending in the lateral direction. A left end portion of the first horizontal driving shaft 137*c* is fixed to part of a vertical intermediate portion of the second lever 4 close to the second axis C2. A right end portion of the first horizontal driving shaft 137*c* is pivotably supported by a rear end portion of the first horizontal driving link 137*a*.

The second horizontal driving shaft 137*d* is formed in a columnar shape extending in the lateral direction. A left end portion of the second horizontal driving shaft 137*d* is pivotably supported by a front end portion of the first horizontal driving link 137*a*. A right end portion of the second horizontal driving shaft 137*d* is fixed to a lower end portion of the second horizontal driving link 137*b*.

The horizontal driving central shaft 137*e* is formed in a columnar shape extending in the lateral direction. A left end portion of the horizontal driving central shaft 137*e* is fixed to a bent portion of the second horizontal driving link 137*b*. A right end portion of the horizontal driving central shaft 137*e* is pivotably supported by the horizontal driving bearing unit 119. Reference character C13 in FIG. 13 designates an axial center of the horizontal driving central shaft 137*e*.

As shown in FIG. 15, the engagement mechanism 140 includes engagement members 141 and an engagement biasing member 142.

The engagement members 141 extend in the horizontal direction. The engagement members 141 are installed on left and right sides as a pair. Front and rear intermediate portions of a rear section of the engagement members 141 are pivotably supported by both of left and right side portions of the horizontal driving base 131. Reference character C14 in FIG. 15 designates a pivotal center of the front and rear intermediate portions of the engagement members 141.

The engagement members 141 have front surfaces 141*a* perpendicular to the horizontal direction. The engagement members 141 have inclined outer side surfaces 141*b* that are inclined to be disposed inward in the lateral direction toward the rear side.

The engagement biasing member 142 biases the pair of engagement members 141 outward in the lateral direction such that postures of the pair of engagement members 141 (positions of the front surfaces 141*a* and the inclined outer side surfaces 141*b*) are maintained. The engagement biasing member 142 is a tensile coil spring that can be expanded and contracted in the lateral direction. Hereinafter, the engagement biasing member 142 is also referred to as "the engagement spring 142." Both ends of the engagement spring 142 are connected to the rear end portions of the pair of engagement members 141, respectively.

An action of the horizontal driving mechanism 130 will be described.

In an initial state of FIG. 13(*a*), the horizontal driving base 131 is biased rearward with respect to the tape holding and driving base 110 by a biasing force of the horizontal driving spring 135.

When the second lever 4 is pulled, the first horizontal driving link 137*a* and the second horizontal driving link 137*b* are interlocked to push the horizontal driving base 131 forward against the biasing force of the horizontal driving spring 135 (see FIG. 13(*b*)). Then, as shown in FIG. 13(*b*), the horizontal driving base 131 is moved forward with respect to the tape holding and driving base 110.

Meanwhile, when the second lever 4 returns, the horizontal driving base 131 returns rearward by the biasing force of the horizontal driving spring 135 (see FIG. 13(*a*)).

At an initial position of FIG. 13(*a*), when the horizontal driving base 131 is disposed at the rearmost side, the engagement members 141 are disposed behind the lower end portion of the column 91. Here, when the horizontal driving base 131 is moved forward, the front surfaces 141*a* of the engagement members 141 come in contact with the lower end portion of the column 91 to push the tape support units 9 forward (see FIG. 13(*b*)).

Then, the rack 108 of the first tape holding unit 9A rotates the pinion 111, and the rack 108 of the second tape holding unit 9B is operated (see FIG. 14). That is, when the first tape holding unit 9A is moved forward, the second tape holding unit 9B is moved rearward.

Since the vertical positioning pin 103 of the second tape holding unit 9B (a member that moves rearward) rides on the upper surface of the upward protrusion 106*b*, the lower end portion of the column 91 of the second tape holding unit 9B does not come in contact with the front surfaces 141*a* of the engagement members 141 (see FIG. 15). Accordingly, the second tape holding unit 9B can move rearward passing the first tape holding unit 9A without collision with the engagement members 141 (see FIG. 15).

The horizontal slider 106 of the second tape holding unit 9B stops rearward movement using the slider stopper 113 (see FIG. 14). Since the second tape holding unit 9B is moved rearward while the horizontal slider 106 is stopped at the slider stopper 113, the horizontal slider 106 is disposed relatively in front of the second tape holding unit 9B. In the second tape holding unit 9B, the upward protrusion 106*b* on which the vertical positioning pin 103 rides is moved forward. Then, the column 91 of the second tape holding unit 9B is moved downward and stopped on an upper surface of the rear portion of the slider main body 106*a* (see FIG. 14) by the biasing force of the vertical tensile/compression spring 104 (see FIG. 13).

When the horizontal driving base 131 is moved rearward, the horizontal driving base 131 returns to its original position for the next operation without driving the tape support units 9. Here, one of the pair of tape support units 9 is moved downward and stopped below the other tape holding unit 9. The engagement members 141 are pivotable about the rotational center C14 of FIG. 15 while bringing the inclined outer side surface 141*b* in contact with the lower end portion of the column 91. Accordingly, the horizontal driving base 131 and the column 91 can pass in the horizontal direction. After passing each other, the pair of engagement members 141 are returned to their original postures by the engagement spring 142. Accordingly, during the next operation, the lower end portion of the column 91 can be captured by the front surfaces 141*a* of the engagement members 141.

An example of an interlocking operation by the levers 3 and 4 will be described.

Table 1 shows an example of the interlocking operation by the levers 3 and 4.

TABLE 1

| | OPERATION LEVER | OPERATION | TAPE CUTTING UNIT | FEEDER | TAPE SUPPORT DRIVING UNIT |
|---|---|---|---|---|---|
| A1 | FIRST LEVER | PULL | DRIVEN CUTTER INITIAL POSITION OPERATION | NOT DRIVEN | DRIVEN RISE UPWARD ONLY |
| A2 | FIRST LEVER + SECOND LEVER | PULL | DRIVEN STORING OPERATION | DRIVEN TAPE FEEDING OPERATION | DRIVEN HORIZONTAL MOVEMENT + DESCEND REARWARD ONLY |
| A3 | FIRST LEVER + SECOND LEVER | RETURN | DRIVEN STORAGE RELEASE | DRIVEN ACTION OF CLUTCH | DRIVEN ONLY HORIZONTAL DRIVE BASE IS RETURNED |
| A4 | FIRST LEVER | RETURN | DRIVEN TAPE CUTTING OPERATION | NOT DRIVEN | NOT DRIVEN |

As shown in Table 1, when the first lever 3 is pulled, the tape cutting unit 7 and the tape support driving unit 10 are driven. Specifically, when the first lever 3 is pulled to the position of the second lever 4, in the pair of tape support units 9, only the tape holding unit 9 disposed on the front side is moved upward while an initial position operation of the rotary cutter 71 is performed.

Next, when the first lever 3 and the second lever 4 are pulled, the tape cutting unit 7, the feeder 6 and the tape support driving unit 10 are driven. Specifically, when the first lever 3 and the second lever 4 are pulled to the grip 2, a storing operation of the rotary cutter 71, a feeding operation of the adhesive tape 15 and a horizontal movement operation of the pair of tape support units 9 are performed. The pair of tape support units 9 pass forward and rearward. Here, in the pair of tape support units 9, only the tape holding unit 9 disposed on the rear side is moved downward.

Next, when the first lever 3 and the second lever 4 return, the tape cutting unit 7, the feeder 6 and the tape support driving unit 10 are driven. Specifically, when the first lever 3 returns to the position of the second lever 4 and the second lever 4 returns to the initial position, storage release of the rotary cutter 71 is performed. Here, a feeding operation of the adhesive tape 15 is not restored by the action of the clutch 63*g*. Only the horizontal driving base 131 of the tape support driving unit 10 returns to the initial position.

Next, when the first lever 3 returns, the tape cutting unit 7 is driven. Specifically, when the first lever 3 returns to the initial position, a cutting operation (a tape cutting operation) of the adhesive tape 15 is performed by the rotary cutter 71.

The pair of tape support units 9 alternately perform upward movement, rearward movement, downward movement and forward movement through an interlocking operation by the above-mentioned levers 3 and 4.

According to the embodiment, the binding mechanism 1 holds the base 5, the feeder 6, the tape cutting unit 7, the tape support units 9 and the tape support driving unit 10. The feeder 6 is supported by the base 5. The feeder 6 feeds the adhesive tape 15. The tape cutting unit 7 is supported by the base 5. The tape cutting unit 7 cuts the fed adhesive tape 15. The tape support units 9 can hold the fed adhesive tape 15. The tape support units 9 are installed as a pair. The tape support driving unit 10 drives the pair of tape support units 9 such that the pair of tape support units 9 holds the fed adhesive tape 15 simultaneously. According to the above-mentioned configuration, the following effects are exhibited. Since the fed adhesive tape 15 is simultaneously held by the pair of tape support units 9, the adhesive tape 15 can be firmly held in comparison with the case in which the fed adhesive tape 15 is held by only one tape holding member. Accordingly, the adhesive tape 15 can be securely held with an arbitrary posture of the main body.

For example, when the only one tape holding member is provided, one end of the adhesive tape 15 may be unintentionally adhered to a component of the binding mechanism 1 (the rotary cutter 71 or the like). When a stretchable tape is used, the tape may be unexpectedly elongated at the time of cutting. That is, when the only one tape holding member is provided, holding and cutting of the adhesive tape may not be performed reliably. On the other hand, according to the embodiment, since the adhesive tape 15 can be firmly held by the pair of tape support units 9, holding and cutting of the adhesive tape 15 can be performed reliably.

According to the embodiment, the binding mechanism 1 includes the grip 2, the levers 3 and 4, the base 5, the feeder 6, the tape cutting unit 7, the tape adhesion unit 8, the tape support units 9 and the tape support driving unit 10. The levers 3 and 4 are biased in a direction away from the grip 2. The levers 3 and 4 are movable in a direction of approach to the grip 2. The base 5 is fixed to the grip 2. The feeder 6 is supported by the base 5. The feeder 6 is interlocked with the lever 4 to feed the adhesive tape 15. The tape cutting unit 7 is supported by the base 5. The tape cutting unit 7 cuts the fed adhesive tape 15 in conjunction with the lever 3. The tape adhesion unit 8 attaches the cut adhesive tape 15 to a paper bundle. The tape support units 9 can hold the fed adhesive tape 15. The tape support driving unit 10 is interlocked with the levers 3 and 4 to drive the tape support units 9. The tape support driving unit 10 holds the fed adhesive tape 15 using the tape support units 9 and provides the fed adhesive tape 15 to the tape adhesion unit 8. According to the above-mentioned configuration, the following effects are exhibited. Since each of the feeder 6, the tape cutting unit 7 and the tape support units 9 can be interlocked and driven with the levers 3 and 4, a plurality of interlocking operations can be realized by one operation (one action). In addition, a handy type binding mechanism 1 that is not motorized may be provided.

Since the tape support driving unit 10 drives the pair of tape support units 9 such that the tape cutting unit 7 can cut the adhesive tape 15 between the holding sections of the adhesive tape 15 when the adhesive tape 15 is pressed by the pair of tape support units 9, the following effects are exhibited. Since the cut surface of the adhesive tape 15 can be pressed by both sides of the adhesive tape 15 in the feeding direction, the adhesive tape 15 can be reliably cut.

Since the pair of tape support units 9 include the pair of holding plates 92 that are separated from each other such that a paper bundle can be inserted therebetween, the following effects are exhibited. Since an adhesive surface of the paper bundle can be pressed by the pair of holding plates 92, the cut adhesive tape 15 can be reliably adhered to the paper bundle.

Since the feeder 6, the tape cutting unit 7 and the tape support driving unit 10 include operation input shafts (the virtual shaft and the second lever shaft 42) disposed on the same axis, the following effects are exhibited. The feeder 6, the tape cutting unit 7 and the tape support driving unit 10 can be operated collectively by an input to the operation input shaft. In addition, in comparison with the case in which the feeder 6, the tape cutting unit 7 and the tape support driving unit 10 include different operation input shafts, simplification and reduction in size of the configuration of the apparatus can be achieved.

Since the tape support driving unit 10 can move the pair of tape support units 9 in the feeding direction of the adhesive tape 15, the following effects are exhibited. The fed adhesive tape 15 can be also fed with the pair of tape support units 9 by the feeder 6. Accordingly, the pair of tape support units 9 may have a function as the feeder 6.

Since the binding mechanism 1 include an interlocking switching mechanism (the tape feeding force transmission mechanism 63 and the cutting force transmission mechanism 78) configured to switch between a process in which the feeder 6 and the tape cutting unit 7 are interlocked and a process in which they are not interlocked, the following effects are exhibited. Since performance of the tape cutting operation can be avoided during the tape feeding operation, the adhesive tape 15 can be reliably cut.

Since the tape support driving unit 10 includes the vertical driving mechanism 120 configured to drive the pair of tape support units 9 in the vertical direction and the horizontal driving mechanism 130 configured to drive the pair of tape support units 9 in the horizontal direction, the following effects are exhibited. Since vertical movement and horizontal movement of the pair of tape support units 9 can be smoothly performed, feeding and cutting of the adhesive tape 15 can be smoothly performed.

Since the tape support driving unit 10 includes the first lever 3 configured to input an operation to the vertical driving mechanism 120, and the second lever 4 configured to input an operation to the horizontal driving mechanism 130, the following effects are exhibited. Since a tape feeding operation in the horizontal direction and a tape cutting operation in the vertical direction can be separately performed, feeding and cutting of the adhesive tape 15 can be reliably performed.

Since the tape cutting unit 7 includes the cutting force transmission mechanism 78 configured to perform a storing operation of storing a cutting force in a direction opposite to the cutting direction of the adhesive tape 15 and a cutting operation of applying the cutting force in the cutting direction of the adhesive tape 15, the following effects are exhibited. The adhesive tape 15 can be reliably cut by the cutting operation while avoiding performance of the tape cutting operation due to the storing operation during the tape feeding operation.

Since the cutting force transmission mechanism 78 includes two springs having different spring constants (the first tensile spring 78*q* and the second tensile spring 78*r*), the following effects are exhibited. Since the two springs constitute the cutting force transmission mechanism 78, simplification of the configuration of the apparatus can be achieved. In addition, the storing operation and the cutting operation can be realized by a simple configuration.

Since the tape support driving unit 10 alternately drives the pair of tape support units 9 in the vertical direction and drives the pair of tape support units 9 to pass each other in the horizontal direction, the following effects are exhibited. Since operations of the pair of tape support units 9 can be smoothly performed, feeding and cutting of the adhesive tape 15 can be smoothly performed.

Since the cover guide 13 configured to serve for both of a cover function of the tape cutting unit 7 and a guide function of a paper bundle is further provided, the following effects are exhibited. In comparison with the case in which a cover member of the tape cutting unit 7 and a guide member of the paper bundle are separately and individually provided, the number of parts can be reduced and reduction in costs can be achieved.

Since the springs of the mechanisms are drawn by pulling the levers 3 and 4, when the levers 3 and 4 are returned, the levers 3 and 4 can be returned to their original positions by recovery forces of the springs. That is, when the levers 3 and 4 return, that is preferable because the operation is finished by simply releasing a hand (a finger) from the levers 3 and 4 even when this operation is not performed by the hand.

Hereinafter, a variant of the embodiment will be described.

A first variant of the embodiment will be described.

While the case in which the binding mechanism 1 includes the grip 2 and the levers 3 and 4 has been described in the embodiment, there is no limitation thereto.

Figure 16:
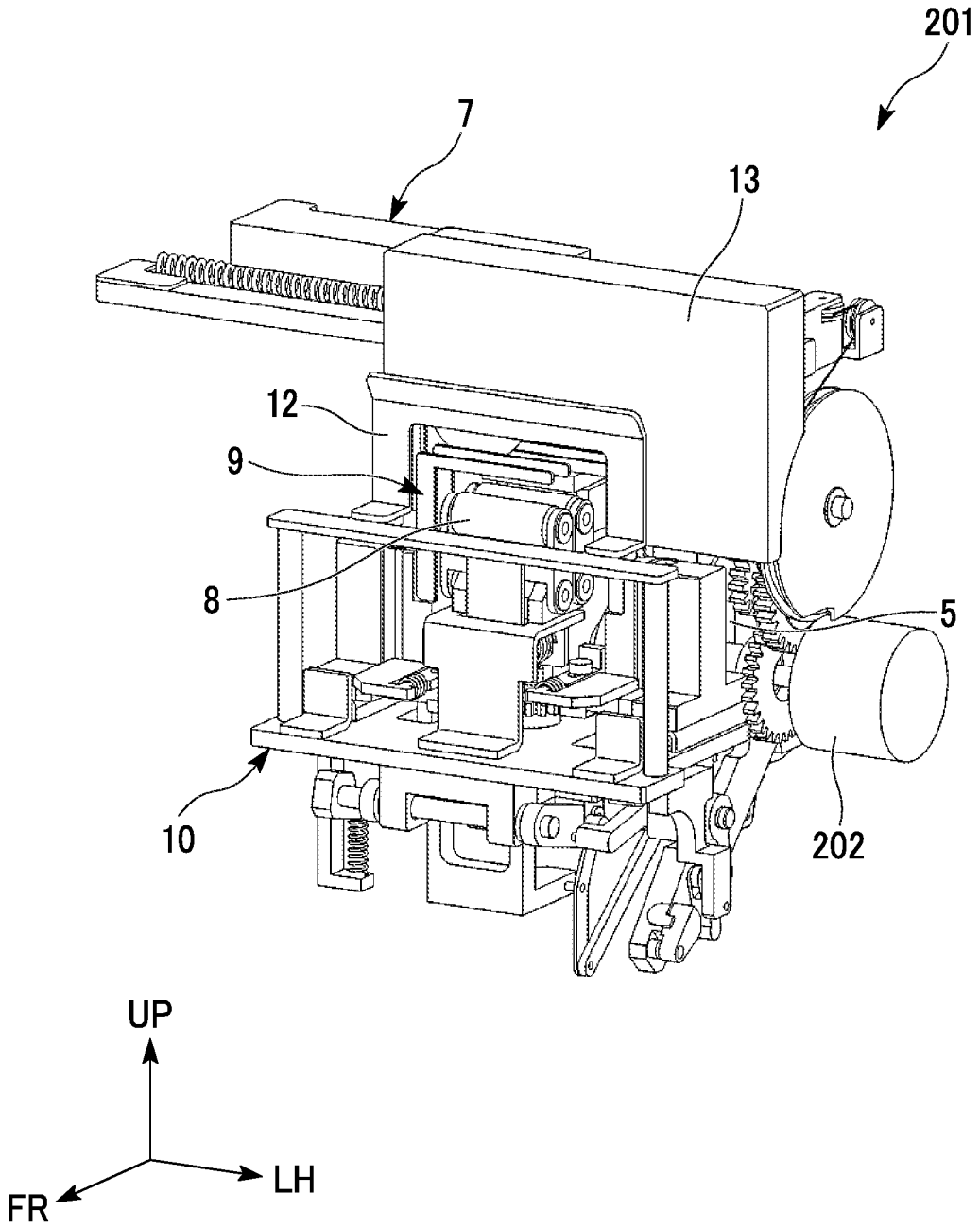
FIG. 16 is a perspective view of a binding unit according to a first variant of the embodiment.

FIG. 16 is a perspective view of a binding unit 201 according to the first variant of the embodiment.

As shown in FIG. 16, the binding unit 201 does not have the grip 2 and the levers 3 and 4. The binding unit 201 may include a driving motor 202 configured to drive the feeder 6, the tape cutting unit 7 and the tape support driving unit 10. For example, the driving motor 202 drives the operation input shaft.

According to the first variant, since the binding unit 201 includes the driving motor 202 configured to drive the feeder 6, the tape cutting unit 7 and the tape support driving unit 10, the following effects are exhibited. Since the feeder 6, the tape cutting unit 7 and the tape support units 9 can be driven by the driving motor 202, a plurality of interlocking operations can be realized electrically. In addition, the binding unit 201 that realizes installation in (building into) the image forming apparatus can be provided.

A second variant of the embodiment will be described.

While the case in which an insertion path of a paper bundle is formed in a linear shape in the vertical direction has been described in the embodiment, there is no limitation thereto.

Figure 17:
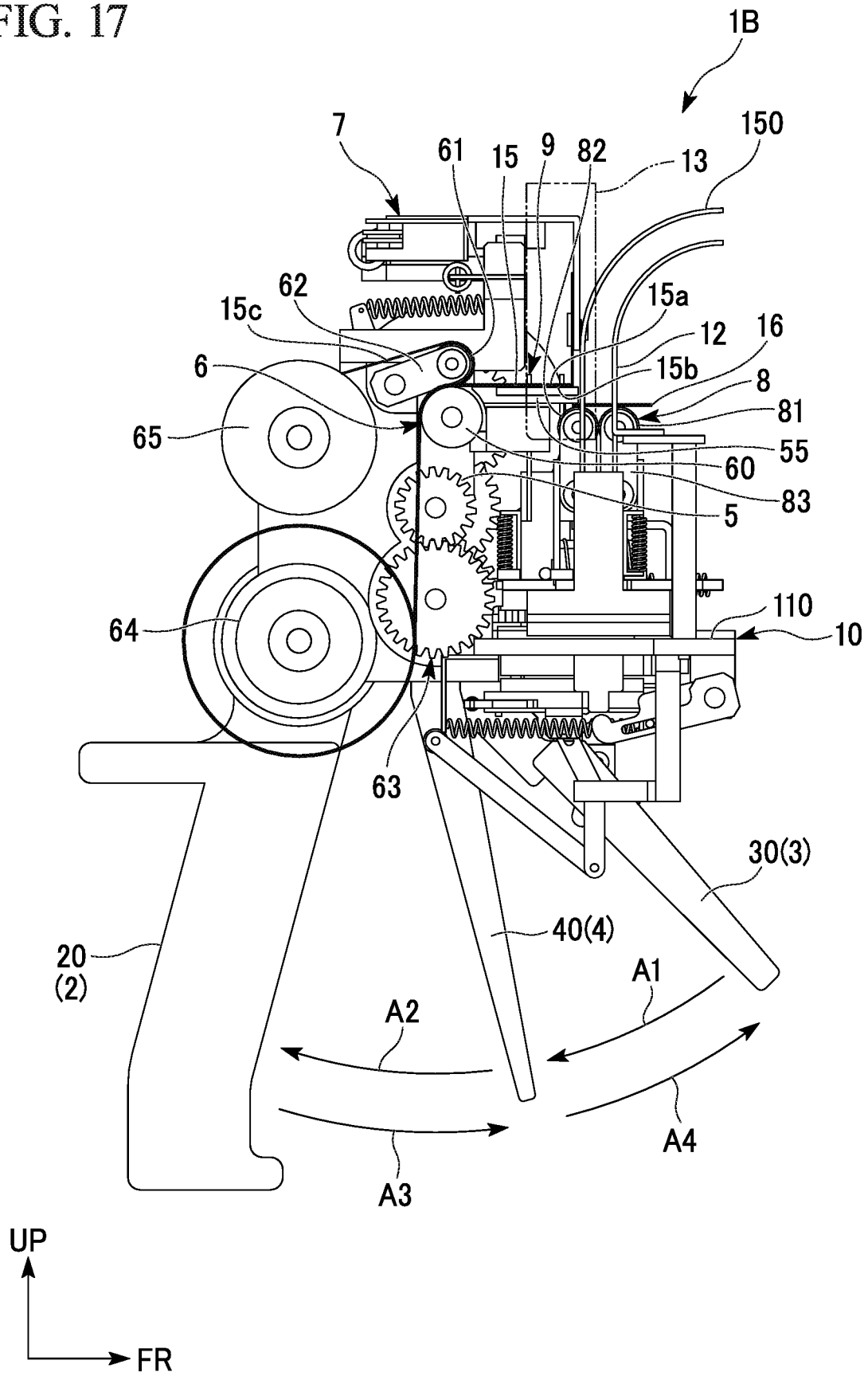
FIG. 17 is a side view of a binding mechanism according to a second variant of the embodiment.

FIG. 17 is a side view of a binding mechanism 1B according to the second variant of the embodiment.

As shown in FIG. 17, the binding mechanism 1B may further include a curve guide 150 configured to bend an insertion path of a paper bundle. The curve guide 150 is attached to an upper end portion of the paper guide 12. The curve guide 150 extends while curving in an arc shape to be disposed forward toward the upper side from the upper end portion of the paper guide 12.

According to the second variant, since the binding mechanism 1B includes the curve guide 150 configured to bend an insertion path of a paper bundle, the following effects are exhibited. The paper bundle can be set to a state of being shifted at the edge portion by bending the paper bundle. Accordingly, the cut adhesive tape 15 can be reliably adhered to the paper bundle. For example, a plurality of sheets of paper that form a paper bundle can be shifted at edge portions in a stepped shape.

While the case in which the binding mechanism includes the two levers has been described in the above-mentioned embodiment, there is no limitation thereto. For example, the binding mechanism may include one or three levers or more.

While the case in which the tape support units are installed as a pair has been described in the embodiment, there is no limitation thereto. For example, one or three tape support units or more may be installed.

While the case in which the biasing member is a coil spring has been described in the above-mentioned embodiment, there is no limitation thereto. For example, the biasing member may be a leaf spring or may be an elastic body such as a rubber member or the like.

While the case in which the link mechanism is provided as a transmission means from the lever to the vertical driving mechanism and the horizontal driving mechanism has been described in the above-mentioned embodiment, there is no limitation thereto. For example, a power transmission mechanism constituted by a gear array may be provided as a transmission means from the lever to the vertical driving mechanism and the horizontal driving mechanism.

While the case in which the adhesive tape includes the exfoliation film has been described in the above-mentioned embodiment, there is no limitation thereto. For example, the adhesive tape may not include the exfoliation film. If the releasing reel is not provided, the number of parts can be reduced as long as the tape has no exfoliation film.

According to at least one of the embodiments described above, it is possible to provide the binding mechanism 1 capable of reliably holding the adhesive tape 15 with an arbitrary posture of the main body by including the base 5, the feeder 6 supported by the base 5 and to feed the adhesive tape 15, the tape cutting unit 7 supported by the base 5 and to cut the fed adhesive tape 15, the pair of tape support units 9 to hold the fed adhesive tape 15, and the tape support driving unit 10 to drive the pair of tape support units 9 such that the pair of tape support units 9 hold the fed adhesive tape 15 simultaneously.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A binding mechanism comprising:

a base;

a feeder supported by the base and to feed an adhesive tape;

a tape cutting unit supported by the base and to cut the fed adhesive tape;

a tape adhesion unit to attach the cut adhesive tape to a paper bundle;

a pair of tape support units to hold the fed adhesive tape; and a tape support driving unit to drive the pair of tape support units such that the pair of tape support units hold the fed adhesive tape simultaneously, wherein the tape adhesion unit includes a pair of rollers that face each other.

2. The binding mechanism according to claim 1, wherein the tape support driving unit drives the pair of tape support units such that the tape cutting unit is able to cut the adhesive tape between holding sections of the adhesive tape when the adhesive tape is pressed by the pair of tape support units.

3. The binding mechanism according to claim 1, wherein each of the tape support units includes a pair of holding plates that are separated from each other such that a member to be bound is insertable between the holding plates.

4. The binding mechanism according to claim 1, wherein the feeder, the tape cutting unit and the tape support driving unit comprise operation input shafts disposed on the same axis.

5. The binding mechanism according to claim 1, wherein the tape support driving unit is able to move the pair of tape support units in a direction parallel to a feeding direction of the adhesive tape fed by the feeder.

6. The binding mechanism according to claim 1, further comprising an interlocking switching mechanism to switch between a state in which the feeder and the tape cutting unit are interlocked and a state in which the feeder and the tape cutting unit are not interlocked.

7. The binding mechanism according to claim 1, wherein the tape support driving unit comprises:

a first driving mechanism to drive the pair of tape support units in a direction perpendicular to a feeding direction of the adhesive tape fed by the feeder; and a second driving mechanism to drive the pair of tape support units in a direction parallel to the feeding direction of the adhesive tape fed by the feeder.

8. The binding mechanism according to claim 7, further comprising:

a first operation input unit to input an operation to the first driving mechanism; and a second operation input unit to input an operation to the second driving mechanism.

9. The binding mechanism according to claim 1, wherein the tape cutting unit comprises a cutting force transmission mechanism to perform a storing operation of storing a cutting force in a direction opposite to a cutting direction of the adhesive tape and a cutting operation of applying the cutting force in the cutting direction of the adhesive tape.

10. The binding mechanism according to claim 9, wherein the cutting force transmission mechanism comprises two springs having different spring constants.

11. The binding mechanism according to claim 1, wherein the tape support driving unit alternately drives the pair of tape support units in a direction perpendicular to a feeding direction of the fed adhesive tape by the feeder such that the pair of tape support units pass each other in a direction parallel to the feeding direction of the adhesive tape fed by the feeder alternately.

12. The binding mechanism according to claim 1, further comprising a cover guide to have both a cover function of the tape cutting unit and a guide function of a member to be bound.

13. The binding mechanism according to claim 1, further comprising a curve guide to bend an insertion path of a member to be bound.

14. A binding mechanism comprising:

a grip;

a lever biased in a direction away from the grip and movable in a direction of approach to the grip;

a base fixed to the grip;

a feeder supported by the base and interlocked with the lever to feed an adhesive tape;

a tape cutting unit supported by the base and to cut the fed adhesive tape in conjunction with the lever;

a tape adhesion unit to attach the cut adhesive tape to a paper bundle;

a tape holding unit to hold the fed adhesive tape; and a tape support driving unit interlocked with the lever to drive the tape holding unit, and to hold the fed adhesive tape using the tape holding unit and provide the adhesive tape to the tape adhesion unit, wherein the tape adhesion unit includes a pair of rollers that face each other.

15. A binding unit comprising:

a base;

a feeder supported by the base and to feed an adhesive tape;

a tape cutting unit supported by the base and to cut the fed adhesive tape;

a tape adhesion unit to attach the cut adhesive tape to a paper bundle;

a pair of tape support units to hold the fed adhesive tape;

a tape support driving unit to drive the pair of tape support units such that the pair of tape support units hold the fed adhesive tape simultaneously; and a driving motor to drive the feeder, the tape cutting unit and the tape support driving unit, wherein the tape adhesion unit includes a pair of rollers that face each other.

* * * * *